US009116479B2

(12) United States Patent
Umezawa et al.

(10) Patent No.: US 9,116,479 B2
(45) Date of Patent: Aug. 25, 2015

(54) FIXING CONTROL DEVICE, FIXING CONTROL METHOD, AND IMAGE FORMING APPARATUS

(71) Applicants: Hiroaki Umezawa, Kanagawa (JP); Shiho Shimosaka, Tokyo (JP); Katsunori Kume, Kanagawa (JP); Koh Tokumaru, Tokyo (JP); Osamu Kizaki, Saitama (JP); Noboru Sugiura, Kanagawa (JP); Norikazu Okada, Kanagawa (JP); Atsuki Iwata, Tokyo (JP); Keita Maejima, Kanagawa (JP); Tomoyuki Yamashita, Tokyo (JP)

(72) Inventors: Hiroaki Umezawa, Kanagawa (JP); Shiho Shimosaka, Tokyo (JP); Katsunori Kume, Kanagawa (JP); Koh Tokumaru, Tokyo (JP); Osamu Kizaki, Saitama (JP); Noboru Sugiura, Kanagawa (JP); Norikazu Okada, Kanagawa (JP); Atsuki Iwata, Tokyo (JP); Keita Maejima, Kanagawa (JP); Tomoyuki Yamashita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/210,977

(22) Filed: Mar. 14, 2014

(65) Prior Publication Data

US 2014/0270835 A1 Sep. 18, 2014

(30) Foreign Application Priority Data

| | | |
|---|---|---|
| Mar. 14, 2013 | (JP) | 2013-052501 |
| Mar. 15, 2013 | (JP) | 2013-053927 |
| Apr. 11, 2013 | (JP) | 2013-082748 |
| Mar. 7, 2014 | (JP) | 2014-045488 |

(51) Int. Cl.
*G03G 15/20* (2006.01)

(52) U.S. Cl.
CPC .... *G03G 15/2042* (2013.01); *G03G 2215/2035* (2013.01)

(58) Field of Classification Search
None
See application file for complete search history.

(56) References Cited

U.S. PATENT DOCUMENTS

| | | | | |
|---|---|---|---|---|
| 2008/0003005 | A1 * | 1/2008 | Yamamoto | 399/67 |
| 2008/0069584 | A1 * | 3/2008 | Sanada et al. | 399/88 |
| 2014/0016958 | A1 | 1/2014 | Yabuuchi et al. | |

FOREIGN PATENT DOCUMENTS

| | | |
|---|---|---|
| JP | H07-225524 | 8/1995 |
| JP | 3242585 | 12/2001 |
| JP | 2002-182521 | 6/2002 |
| JP | 3454988 | 10/2003 |
| JP | 2005-181946 | 7/2005 |
| JP | 2011-186059 | 9/2011 |
| JP | 2014-032382 | 2/2014 |

* cited by examiner

*Primary Examiner* — Clayton E LaBalle
*Assistant Examiner* — Jas Sanghera
(74) *Attorney, Agent, or Firm* — Harness, Dickey & Pierce, P.L.C.

(57) ABSTRACT

A fixing control device includes an image detection unit that determines presence of an image in each of areas obtained by division of an image formation region in which the image is formed, a heater selection unit that selects from heaters of a fixing device heaters at positions corresponding to areas in which the presence of the image is determined, a heating amount computation unit that computes a heating amount of a heating area heated by each of the selected heaters in a fixing region corresponding to the image formation region, a change amount computation unit that computes an amount of change of the heating amount between adjoining ones of the heating areas, and a heating amount correction unit that corrects one of the heating amounts of the adjoining heating areas so that the amount of change after the correction is less than a predetermined threshold.

11 Claims, 30 Drawing Sheets

| | | | | | | | | | | |
|---|---|---|---|---|---|---|---|---|---|---|
| | 30 | 30 | 30 | 30 | 30 | 30 | 30 | 30 | 30 | 30 |
| | 30 | 30 | 50 | 100 | 100 | 100 | 100 | 100 | 50 | 30 |
| | 30 | 30 | 50 | 50 | 50 | 100 | 100 | 100 | 50 | 30 |
| | 30 | 30 | 50 | 50 | 50 | 50 | 50 | 50 | 50 | 30 |
| | 30 | 30 | 50 | 100 | 100 | 100 | 100 | 100 | 50 | 30 |
| | 30 | 30 | 50 | 100 | 100 | 50 | 50 | 50 | 50 | 30 |
| | 30 | 30 | 50 | 100 | 50 | 50 | 100 | 100 | 100 | 30 |
| | 30 | 30 | 50 | 100 | 50 | 50 | 100 | 100 | 100 | 30 |
| 203 | 30 | 30 | 50 | 100 | 50 | 50 | 100 | 100 | 100 | 30 |
| 202 | 30 | 30 | 50 | 50 | 50 | 50 | 50 | 50 | 50 | 30 |
| 201 | 30 | 30 | 30 | 30 | 30 | 30 | 30 | 30 | 30 | 30 |

| | | | | | | | | | | |
|---|---|---|---|---|---|---|---|---|---|---|
| SUM OF HEATING AMOUNTS | 330 | 330 | 510 | 810 | 710 | 660 | 810 | 810 | 660 | 330 |

| | | | | | | | | | |
|---|---|---|---|---|---|---|---|---|---|
| CHANGE AMOUNT | 0 | 180 | 300 | -100 | -50 | 150 | 0 | -150 | -330 |

FIXING CONTROL DEVICE, FIXING CONTROL METHOD, AND IMAGE FORMING APPARATUS

BACKGROUND OF THE INVENTION

1. Field of the Invention

The present invention relates to a fixing control device, a fixing control method, and an image forming apparatus which are adapted to control a fixing device including a plurality of heaters to fix an image based on image data to a recording material.

2. Description of the Related Art

Conventionally, there is known an image forming apparatus including a fixing device utilizing a laser beam or a thermal head with good thermal response. In a conventional image forming apparatus including a fixing device, only an area (image area) on a recording material where a toner image is formed or the neighborhood of the area, based on digital image data is selectively heated to fix the non-fixed toner to the recording material. See Japanese Laid-Open Patent Publication No. 7-225524.

In the above-described method, the heaters are simply turned ON and OFF based on the presence of an image on the recording material, and the frequency of turning ON and OFF the heaters is increased. Turning ON and OFF the heaters may produce a rapid voltage fluctuation. Hence, if turning ON and OFF the heaters is frequently performed, the output power of a power source, such as a commercial power source, which is supplied to the image forming apparatus, fluctuates and the possibility of occurrence of flicker increases.

In order to prevent the occurrence of flicker, it is known that a preset temperature of a temperature control of a thermal fixing unit is gradually changed to a target temperature at intervals of a predetermined period of time, and the amount of change of the power supplied to the heat source (fixing heater) is restricted. See Japanese Patent No. 3454988.

However, if the occurrence of flicker is prevented using the above-described method, the response of a temperature change to the area to be heated deteriorates, and the possibility of occurrence of poor fixing increases.

SUMMARY OF THE INVENTION

In one aspect, the present invention provides a fixing control device in which good fixing performance is maintained and occurrence of flicker is prevented.

In one embodiment, the present invention provides a fixing control device which controls a fixing device including a plurality of heaters to fix an image based on image data to a recording material, the fixing control device including an image detection unit configured to determine presence or absence of the image in each of a plurality of areas obtained by division of an image formation region in which the image is formed; a heater selection unit configured to select, from the plurality of heaters, heaters at positions corresponding to areas in which the presence of the image is determined; a heating amount computation unit configured to compute a heating amount of a heating area heated by each of the selected heaters in a fixing region corresponding to the image formation region; a change amount computation unit configured to compute an amount of change of the heating amount between adjoining ones of the heating areas; and a heating amount correction unit configured to correct one of the heating amounts of the adjoining heating areas so that the amount of change after the correction is less than a predetermined threshold.

Other objects, features and advantages of the present invention will be more apparent from the following detailed description when read in conjunction with the accompanying drawings.

DETAILED DESCRIPTION OF THE PREFERRED EMBODIMENTS

A description will be given of embodiments with reference to the accompanying drawings.

First Embodiment

Figure 1:
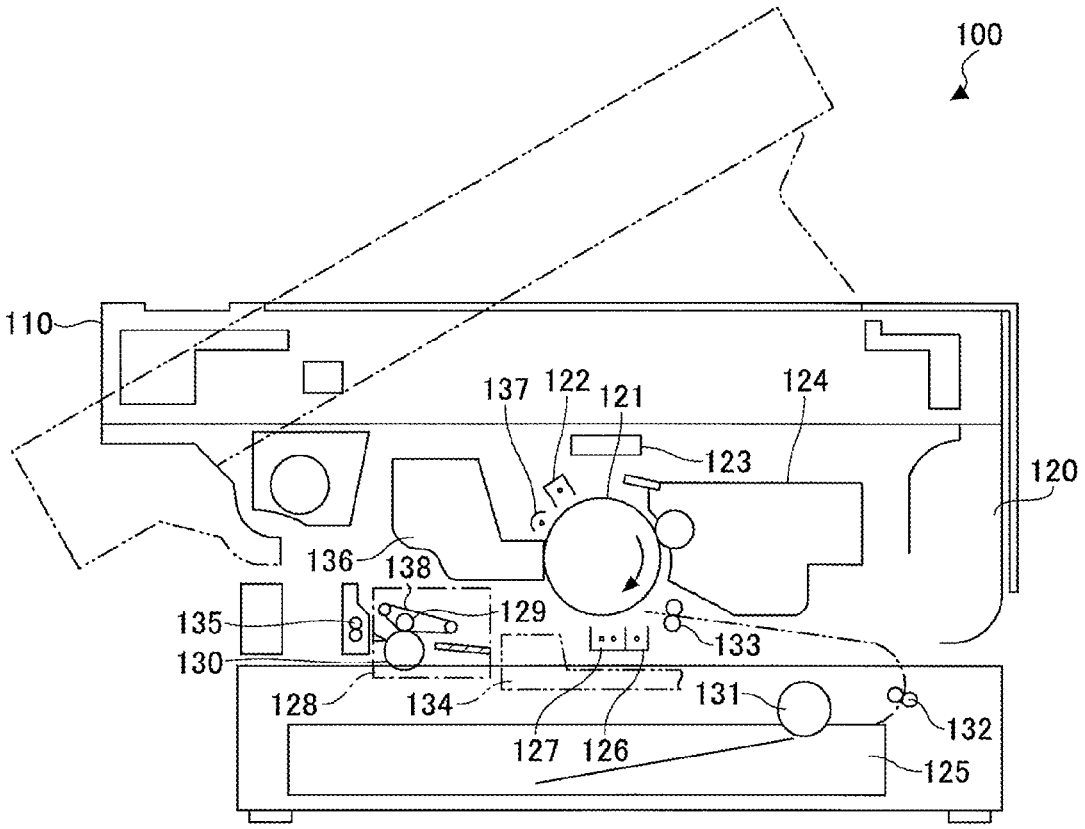
FIG. 1 is a diagram showing the composition of an image forming apparatus according to a first embodiment.

FIG. 1 shows the composition of an image forming apparatus 100 according to a first embodiment. The image forming apparatus 100 includes a scanner unit 110 and a printer unit 120.

In the image forming apparatus 100, the scanner unit 110 converts a reflection light beam from a read document (not shown) into an electric signal, further converts the analog electric signal into a digital image signal, and outputs the image signal to the printer unit 120.

The printer unit 120 performs an image formation operation based on the image data received from the scanner unit 110, or image data received from a computer connected to the image forming apparatus 100.

The printer unit 120 includes a photoconductor drum 121, a charging device 122, a writing device 123, a developing device 124, a sheet feeding device 125, a transfer device 126, a separation device 127, and a fixing device 128.

In this embodiment, the photoconductor drum 121 is uniformly charged by the charging device 122. The image data input to the image forming apparatus 100 is processed by the image processing unit (which will be described later) such that the processing of correction, conversion, scaling, etc., is performed. After the processing is performed, the image data is input to the writing device 123. The writing device 123 irradiates the photoconductor drum 121 with a laser beam based on the input image data. An electrostatic latent image formed on the photoconductor drum 121 is developed with toner by the developing device 124 so that a visible image is formed.

On the other hand, a recording material (not shown) from the sheet feeding device 125 is fed through a transport roller 132 to a registration roller 133 by a feeding roller 131. The registration roller 133 sends out the recording material in synchronization with the toner image on the photoconductor drum 121. The toner image on the photoconductor drum 121 is transferred to the recording material by the transfer device 126.

The recording material is separated from the photoconductor drum 121 by the separation device 127, guided by a transport guide 134, and supplied to the fixing device 128. Heat fixing of the non-fixed toner image on the recording material is performed by the fixing device 128, and the recording material is ejected outside by an ejection roller 135. Moreover, after separation of the recording material, the residual toner is removed from the photoconductor drum 121 by the cleaning device 136 and the residual charge is eliminated from the photoconductor drum 121 by a discharging unit 137.

The image forming apparatus 100 performs fixing control of the fixing device 128 using the image data input to the writing device 123. Namely, the image forming apparatus 100 forms an image on a recording material (e.g., a sheet) by fixing to the recording material the toner image formed on the photoconductor drum 121 based on the image data.

The fixing device 128 according to this embodiment is explained. The fixing device 128 includes a fixing roller 129, a pressure roller 130, and a fixing belt 138. In the fixing device 128, the recording material held between the fixing roller 129 and the pressure roller 130 is transported so that a non-fixed toner image on the recording material is fixed.

In the example of FIG. 1, only one photoconductor drum 121 is provided. However, in a case where the image forming apparatus 100 is arranged to print a color image using toners of two or more colors, a corresponding number of the photoconductor drums 121, a corresponding number of the charging devices 122, a corresponding number of the writing devices 123, and a corresponding number of the developing devices 124 are provided in accordance with the number of the colors of the toners.

Figure 2A:
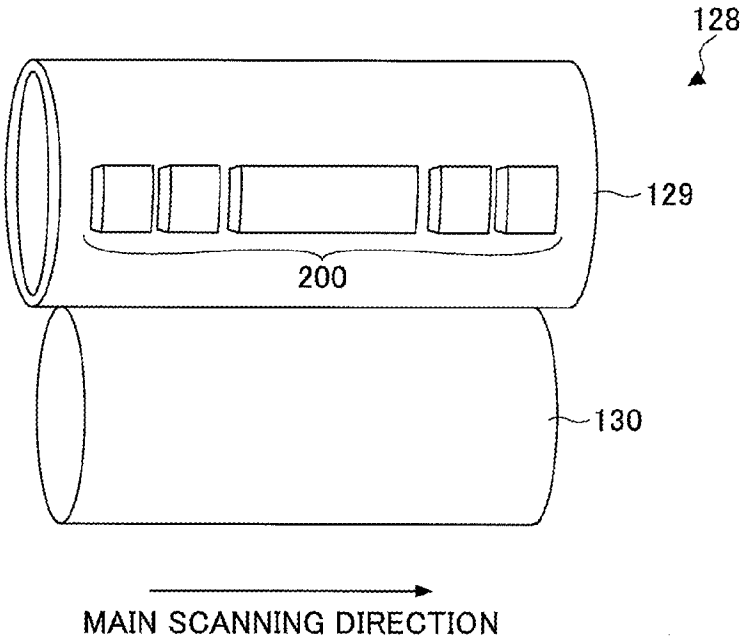
FIG. 2A and FIG. 2B are diagrams for explaining a fixing roller according to the first embodiment.
Figure 2B:
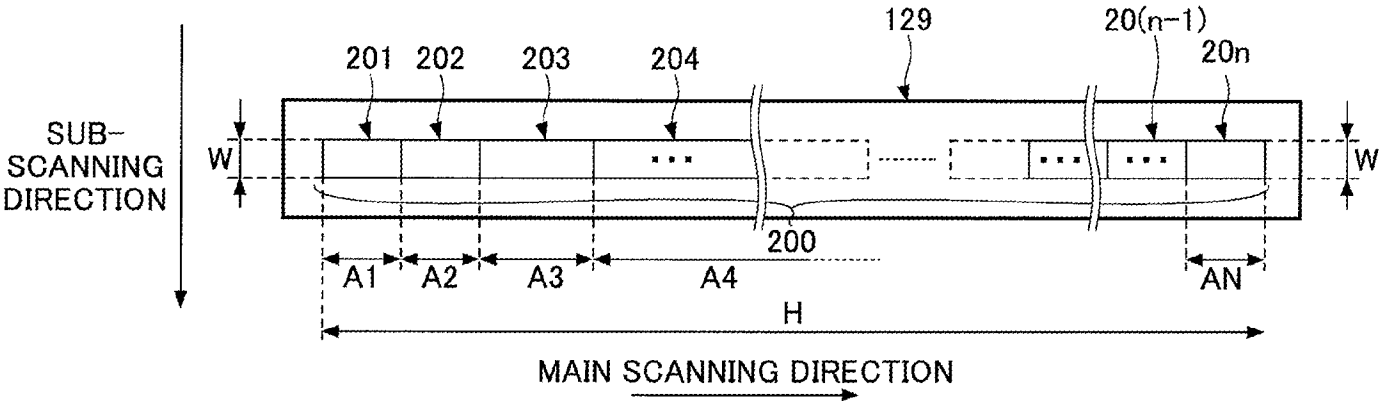

FIG. 2A and FIG. 2B are diagrams for explaining the fixing roller 129 according to the first embodiment. FIG. 2A shows the composition of the fixing roller 129. FIG. 2B shows a heater portion 200 provided in the fixing roller 129.

In this embodiment, the fixing roller 129 includes the heater portion 200 disposed inside the fixing roller 129. For example, the heater portion 200 includes a plurality of heaters 201, 202, . . . , 20($n$−1) and 20$n$. In the following, when the heaters 201, 202, . . . , 20($n$−1) and 20$n$ are collectively referred to, they are simply called the heaters 20$n$.

In this embodiment, the heaters may be implemented by heating elements or filaments for heating an image based on image data and fixing the image to a recording material.

The heaters 20$n$ are explained with reference to FIG. 2B. The heaters 20$n$ may differ in size. Alternatively, the size of each of the heaters 20$n$ may be the same. In the example of FIG. 2B, the heaters 20$n$ differ in size. Specifically, the heaters 20$n$ differ in the width of each heater in a main scanning direction.

In this embodiment, a width A4 in the main scanning direction of a heater 204 at a central portion of the fixing roller 129 is greater than a width AN in the main scanning direction of a heater 20$n$ at one end portion of the fixing roller 129 in the main scanning direction. Specifically, a width A1 in the main scanning direction of a heater 201 at the other end portion of the fixing roller 129, a width A2 of a heater 202, and the width AN of the heater 20$n$ at the end portion of the fixing roller 129 in the main scanning direction are smaller than the width A4 in the main scanning direction of the heater 204. A width A3 in the main scanning direction of a heater 203 is greater than the width A2 in the main scanning direction of the heater 202 and smaller than the width A4 in the main scanning direction of the heater 204.

A possibility that a non-fixed toner image is formed at the center portion of the fixing roller 129 in the main scanning direction is high. Thus, in this embodiment, the heater 204 with the large width is arranged at the center portion of the fixing roller 129 in the main scanning direction. By arranging the heater portion 200 in this manner, the number of the heaters 20$n$ included in the fixing roller 129 may be reduced, and control of the heaters 20$n$ may be simplified.

Moreover, in this embodiment, the widths of the heaters 201 and 20$n$ at the end portions of the fixing roller 129 in the main scanning direction are smaller than the width of the heater 204 at the center portion of the fixing roller 129 in the main scanning direction. Thereby, when end portions of a recording material in the main scanning direction are heated, the heaters located in accordance with a region where the non-fixed toner image is not formed may be turned OFF.

The heater 20*n* is turned ON to heat the area of the fixing roller 129 which area is defined by a length W in the sub-scanning direction and a width X in the main scanning direction which width is the same as the width AN of the heater 20*n*. In this embodiment, the respective lengths W of the heaters 20*n* in the sub-scanning direction are the same. It is preferred to determine the respective widths of the heaters in the main scanning direction and the number of the heaters such that an overall width H of the heater portion 200 in the main scanning direction is in agreement with a width of the recording material in the main scanning direction. Turning ON and OFF the heaters is controlled independently of each other.

For example, the heaters 20*n* in this embodiment may be implemented by an IH (induction heating) coil, a thermal head array, etc.

Figure 3:
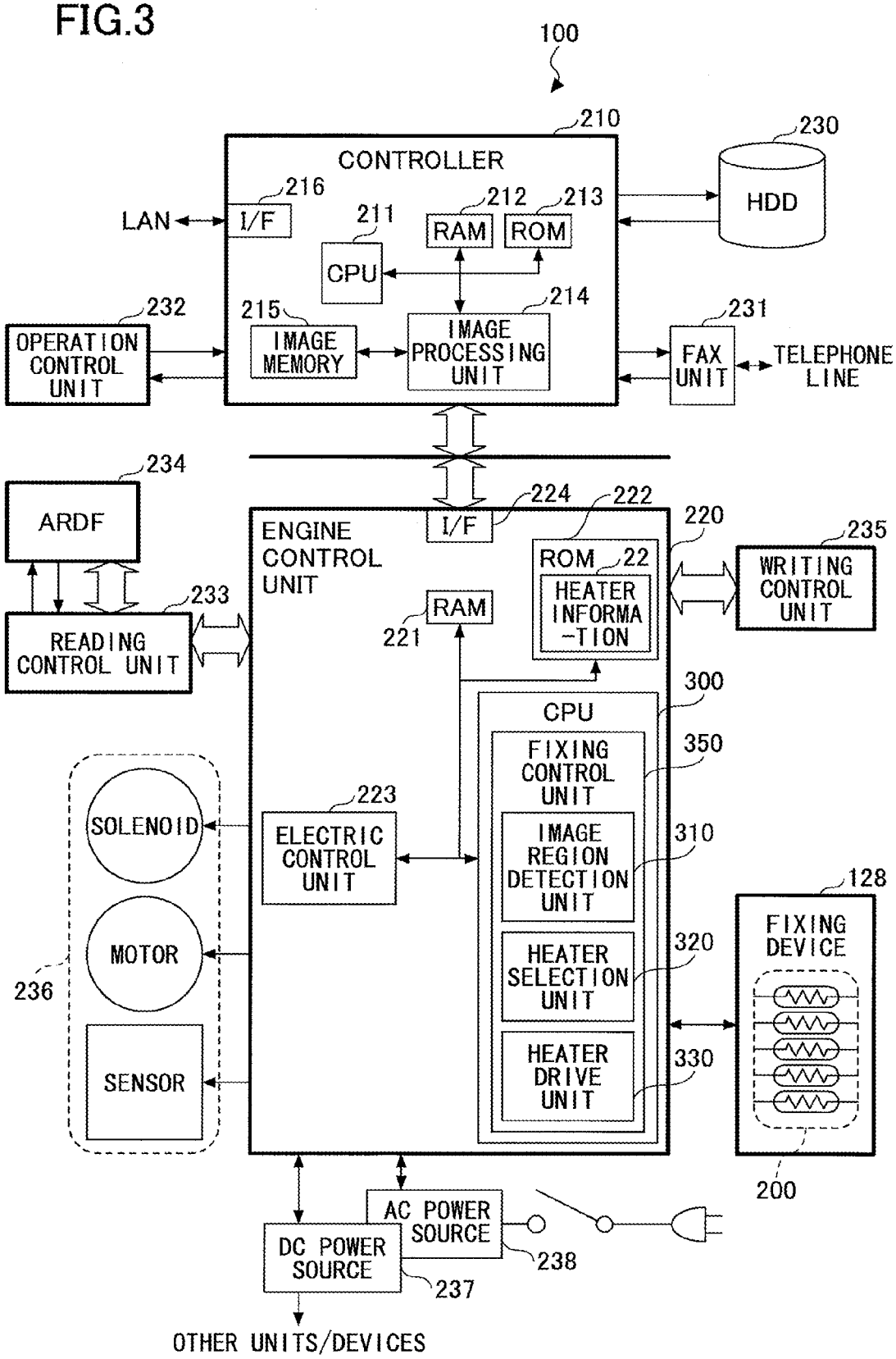
FIG. 3 is a diagram for explaining the composition of the image forming apparatus according to the first embodiment.

Next, the composition of the image forming apparatus 100 according to this embodiment is explained. FIG. 3 is a diagram for explaining the composition of the image forming apparatus 100.

The image forming apparatus 100 includes a controller 210, an engine control unit 220, a HDD (hard disk drive) 230, a FAX unit 231, an operation control unit 232, a reading control unit 233, an ARDF (automatic reversing document feeder) 234, a writing control unit 235, electric components 236, a DC (direct current) power source 237, and an AC (alternating current) power source 238.

The controller 210 receives instructions for setting an image formation operation and sets up the image formation operation. Specifically, the controller 210 controls image formation, user interfaces and mode settings, copier and printer applications, etc., of the image forming apparatus 100.

The engine control unit 220 performs drive control of a printer engine. The HDD 230 stores data of a processing object or the like. The FAX unit 231 performs a facsimile function of the image forming apparatus 100. The operation control unit 232 controls a touch panel (operation panel) used as a user interface.

The reading control unit 233 controls the scanner unit 110 and transmits the read image to an image processing unit 214 in the controller 210 via a PCI (peripheral component interconnect) bus.

The writing control unit 235 controls the writing device 123 and controls the emission or irradiation of a laser beam based on the image data received from the controller 210 or the reading control unit 233 via the PCI bus. In this embodiment, by the irradiation of the photoconductor drum 121 with the laser beam, an electrostatic latent image is formed on the photoconductor drum 121 based on the image data.

Specifically, the writing control unit 235 generates a light-on control signal to control lighting of an LD (laser diode) included in a LD unit or an LED (light emitting diode) included in an LED unit, based on the image data. The writing control unit 235 of this embodiment controls the lighting of the LD by outputting the light-on control signal, and writes an electrostatic latent image on the photoconductor drum 121 with the laser beam. Moreover, the writing control unit 235 of this embodiment performs a process (which will be described later) for treating an image region in which an image is formed by the LD as a plurality of areas. In this embodiment, it is assumed that the image region in which the image is formed is a writing region on the photoconductor drum 121 scanned by the laser beam emitted from the LD.

The details of the writing control unit 235 will be described later. In the following, it is assumed that the light-on control signal in this embodiment controls lighting of an LD of the writing control unit 235.

The electronic components 236 include a temperature sensor, a motor, a solenoid, etc. The DC power source 237 and the AC power source 238 supply power to each of the control units.

Next, the composition of the controller 210 is explained. The controller 210 includes a CPU (central processing unit) 211, a RAM (random access memory) 212, a ROM (read-only memory) 213, an image processing unit 214, an image memory 215, and an I/F (interface) 216.

The CPU 211 performs various processing operations. The RAM 212 temporarily stores a variety of information items. The ROM 213 stores a control program. The image processing unit 214 is implemented by, for example, an ASIC (application-specific integrated circuit) which performs image processing. The image memory 215 stores the image data processed by the image processing unit 214. The interface 216 transmits information to and receives information from an external communication device via a network, such as LAN (local area network).

Moreover, the controller 210 may include an NVRAM (non-volatile RAM) which is not illustrated, and setup information of operating conditions of the image forming apparatus 100 may be stored in the NVRAM.

The controller 210 is connected to the HDD 230 which stores data of the processing object, and connected to the operation control unit 232 which serves as the user interface.

The controller 210 is linked to the FAX unit 231 and the engine control unit 220 via a PCI bus and an interface 224. The controller 210 receives instructions of image formation operation through the interface 216 from the operation control unit 232 or an external device, performs the image formation operation, and transmits the generated image to the engine control unit 220 via the PCI bus.

The engine control unit 220 includes a CPU 300, a RAM 221, a ROM 222, and an electric control unit 223. The CPU 300 performs various processes of the engine control unit 220. The CPU 300 of this embodiment performs fixing control for the fixing device 128. The fixing control performed by the CPU 300 will be described later. The RAM 221 temporarily stores a variety of information items. The ROM 222 stores a control program. In this embodiment, a fixing control program may be stored in the ROM 222. Moreover, heater information 22 (which will be described later) may be stored in the ROM 222. The electric control unit 223 controls the electronic components 236.

Next, the functional composition of the CPU 300 is explained. The CPU 300 of this embodiment includes a fixing control unit 350. The fixing control unit 350 includes an image region detection unit 310, a heater selection unit 320, and a heater drive unit 330.

The image region detection unit 310 is configured to determine the presence or absence of an image in the areas of the writing region area by area based on a counted value obtained from the writing control unit 235. The heater selection unit 320 is configured to select the heaters 20*n* which are to be turned ON to heat the corresponding areas in which the image is present. The details of processing of the image region detection unit 310 and the heater selection unit 320 will be described later. The heater drive unit 330 is configured to drive the selected heaters 20*n*.

In the image forming apparatus 100 of this embodiment, the light-on control signal generated by the writing control unit 235 is taken as data for each of predetermined areas of the writing region, and determines the presence of the image in each of the areas of the writing region. The heater selection unit 320 selects the heaters 20*n* corresponding to the areas in which the image is present, and assigns the areas to the corresponding heaters 20*n*. The heater drive unit 330 drives the selected heaters 20*n* to heat the areas. The details of the driving of the heaters 20*n* by the heater drive unit 330 will be described later.

Although not illustrated, the image forming apparatus 100 of this embodiment has a heater temperature monitoring function using a temperature sensor which monitors a temperature state of the heater portion 200.

In the above embodiment, the image region detection unit 310 is included in the engine control unit 220. Alternatively, the image region detection unit 310 may be included in the image processing unit 214 of the controller 210. In this case, the controller 210 may send to the engine control unit 220 a notification of a result of the process by the image region detection unit 310.

Figure 4:
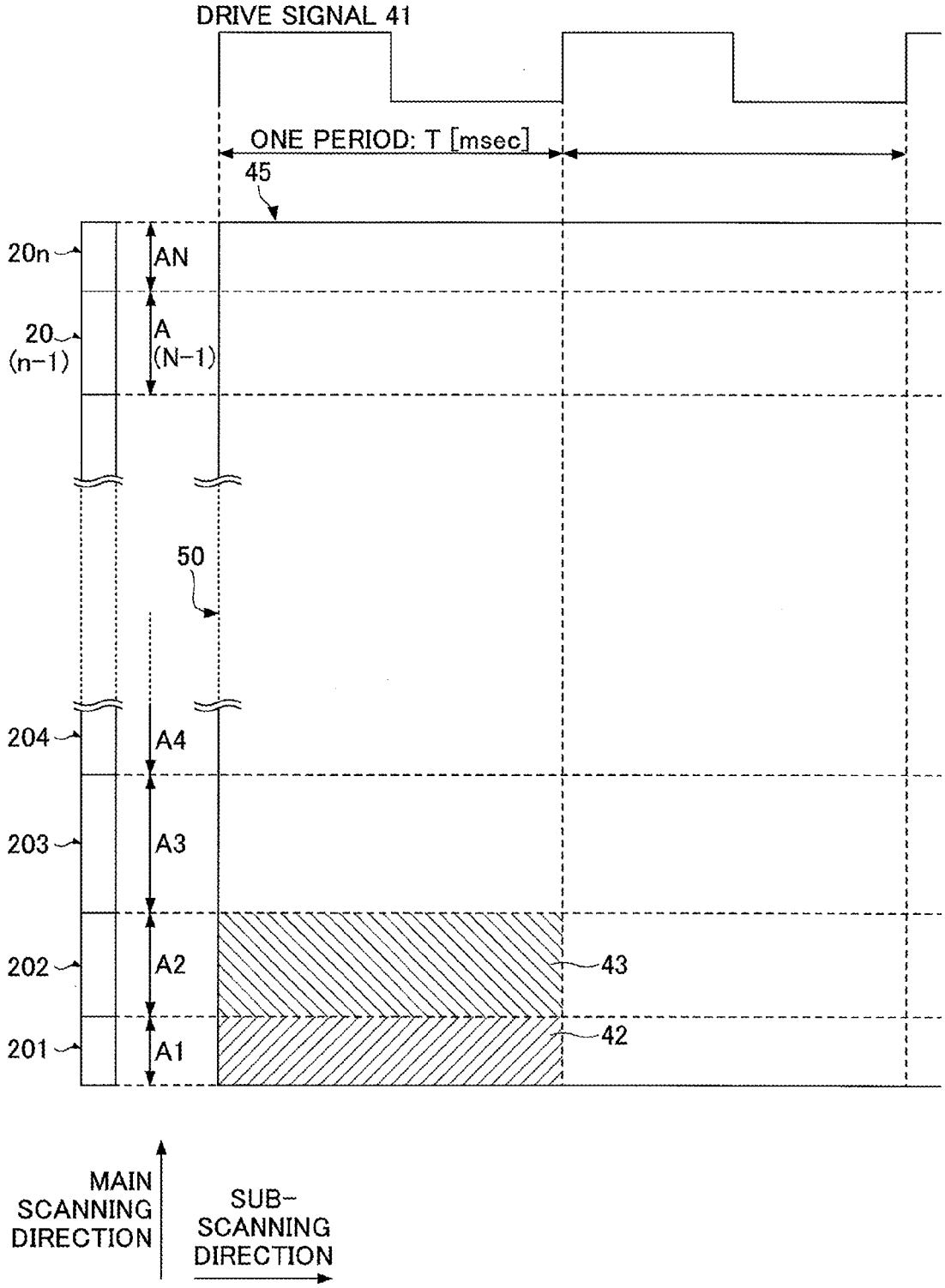
FIG. 4 is a diagram for explaining driving of heaters by a heater drive unit.

Next, the driving of the heaters 20*n* by the heater drive unit 330 according to this embodiment is explained. FIG. 4 is a diagram for explaining the driving of the heaters by the heater drive unit 330.

The heater drive unit 330 is configured to drive the heaters 20*n* by a drive signal 41 of a predetermined period. For example, a case where the heater 201 shown in FIG. 4 is driven by the heater drive unit 330 is explained.

The drive signal 41 is a signal with a duty ratio (indicating a ratio of a high level (H level) and a low level (L level)) which is equal to 50%. When the drive signal 41 is at H level, power is supplied to the heater 201, and when the drive signal 41 is at L level, the power supply to the heater 201 is cut off.

In the following, supplying power to the heater 20*n* may be expressed as turning ON the heater 20*n*, and cutting off the power supply to the heater 20*n* may be expressed as turning OFF the heater 20*n*.

The heater drive unit 330 is configured to change the duty ratio of the drive signal 41, control a time (on-time) for which the power is supplied to the heater 201, and control the heating amount of the heater 201. As the on-time is changed to a longer time, the heating amount of the heater 201 increases. Similarly, turning ON/OFF of other heaters 20*n* than the heater 201 is controlled by the drive signal 41 of the predetermined period.

In the example of FIG. 4, when the drive signal 41 is at H level, the heater 201 is turned ON (the power is supplied to the heater 201). The present disclosure is not limited to this example. Alternatively, the heater 201 may be turned ON when the drive signal 41 is at L level, and when the drive signal 41 is at H level, the heater 201 may be turned OFF.

Next, the heating area which is heated by the heater 201 is explained. In this embodiment, an area in a region on the fixing belt 138 corresponding to the writing region, which area is heated by the heater 20*n* turned ON by the drive signal 41 for one period, is called a heating area. The heating area is a minimum unit of the region the heating amount of which may be controlled independently when an image is fixed to a recording material by heating the image by each of the heaters 20*n*. The heating amount is an amount of heat corresponding to the heating amount of the heater 20*n*.

In the following, controlling the heating amount of the heater 20*n* may be expressed as controlling the amount of heat of the heater 20*n*. The region on the fixing belt 138 which is heated by the heaters 201-20*n* is called a fixing region. The fixing region is a region corresponding to the writing region.

In a fixing region 45 shown in FIG. 4, when the width of the heater 201 is set to A1 and one period of the drive signal 41 is set to T ms, the heating area of the heater 201 is represented by the width A1×(the transporting speed in the sub-scanning direction)×T ms. In FIG. 4, the heating area of the heater 201 is indicated by a heating area 42. The heating area of the heater 202 is represented by the width A2×(the transporting speed in the sub-scanning direction)×T ms. In FIG. 4, the heating area of the heater 202 is indicated by a heating area 43. Namely, the heating area of the heater 20*n* may be obtained by the width of the heater 20*n* in the main scanning direction×(the transporting speed in the sub-scanning direction)×one period of the drive signal 41.

In the example of FIG. 4, the heating amount of the heater 201 is controlled by the on-time of the heater 201 of the drive signal 41. The present disclosure is not limited to this example. Alternatively, the heating amount of the heater 201 may be controlled by supplying the current of predetermined amplitude for one period, instead of the drive signal 41. In this case, the heating amount of the heater 201 is controlled through the control of the current value.

Figure 5:
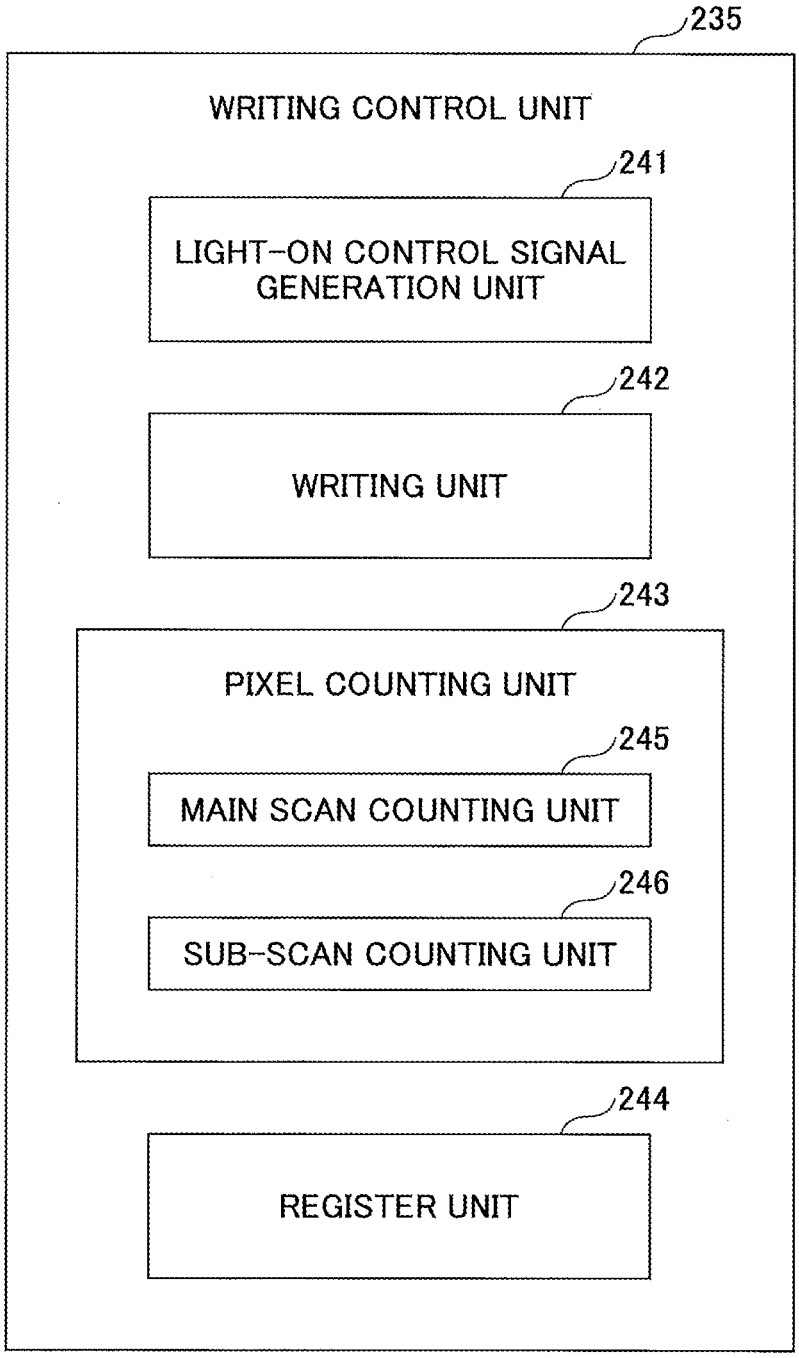
FIG. 5 is a diagram for explaining the functional composition of a writing control unit.

Next, the functional composition of the writing control unit 235 according to this embodiment is explained. FIG. 5 is a diagram for explaining the functional composition of the writing control unit 235.

The writing control unit 235 includes a light-on control signal generation unit 241, a writing unit 242, a pixel counting unit 243, and a register unit 244. The light-on control signal generation unit 241 is configured to generate a light-on control signal which controls ON/OFF of lighting of the LD based on the image data received from the controller 210. The light-on control signal is represented by writing data for causing the LD to emit a laser beam based on the image data and write an electrostatic latent image on the photoconductor drum 121 with the laser beam.

The writing unit 242 is configured to control the ON/OFF of the lighting of the LD in accordance with the light-on control signal generated by the light-on control signal generation unit 241, and write the electrostatic latent image on the photoconductor drum 121 with the laser beam. Specifically, the writing unit 242 turns ON the lighting of the LD when the light-on control signal is at H level, and when the light-on control signal is at L level, the writing unit 242 turns OFF the lighting of the LD.

The pixel counting unit 243 is configured to count the pixels of the LD writing region based on the light-on control signal. The counted value obtained by the pixel counting unit 243 is stored in the register unit 244. The details of the pixel counting unit 243 and the register unit 244 will be described later.

Although the illustration is omitted in FIG. 5, when a color image is formed using toners of two or more colors, a corresponding number of the photoconductor drums 121 are provided for the number of the colors, and the light-on control signal generation unit 241, the writing unit 242, and the pixel counting unit 243 are provided for the photoconductor drum 121 of each color. In this case, the register unit 244 is shared by the pixel counting units 243 corresponding to the respective colors.

Next, the pixel counting unit 243 according to this embodiment is explained. The pixel counting unit 243 includes a main scan counting unit 245 and a sub-scan counting unit 246. The main scan counting unit 245 is configured to count the pixels in the main scanning direction of the LD writing region based on the light-on control signal. Specifically, the main scan counting unit 245 counts the number of times that the lighting of the LD in the main scanning direction is turned ON. In other words, the main scan counting unit 245 counts the number of times that the level of the light-on control signal is changed from L level to H level. In this embodiment, when the lighting of the LD is turned ON once by the light-on control signal, a portion of the electrostatic latent image corresponding to one pixel is formed on the photoconductor drum 121.

The sub-scan counting unit 246 is configured to count the number of scan lines in the sub-scanning direction in the writing region based on the light-on control signal.

Figure 6:
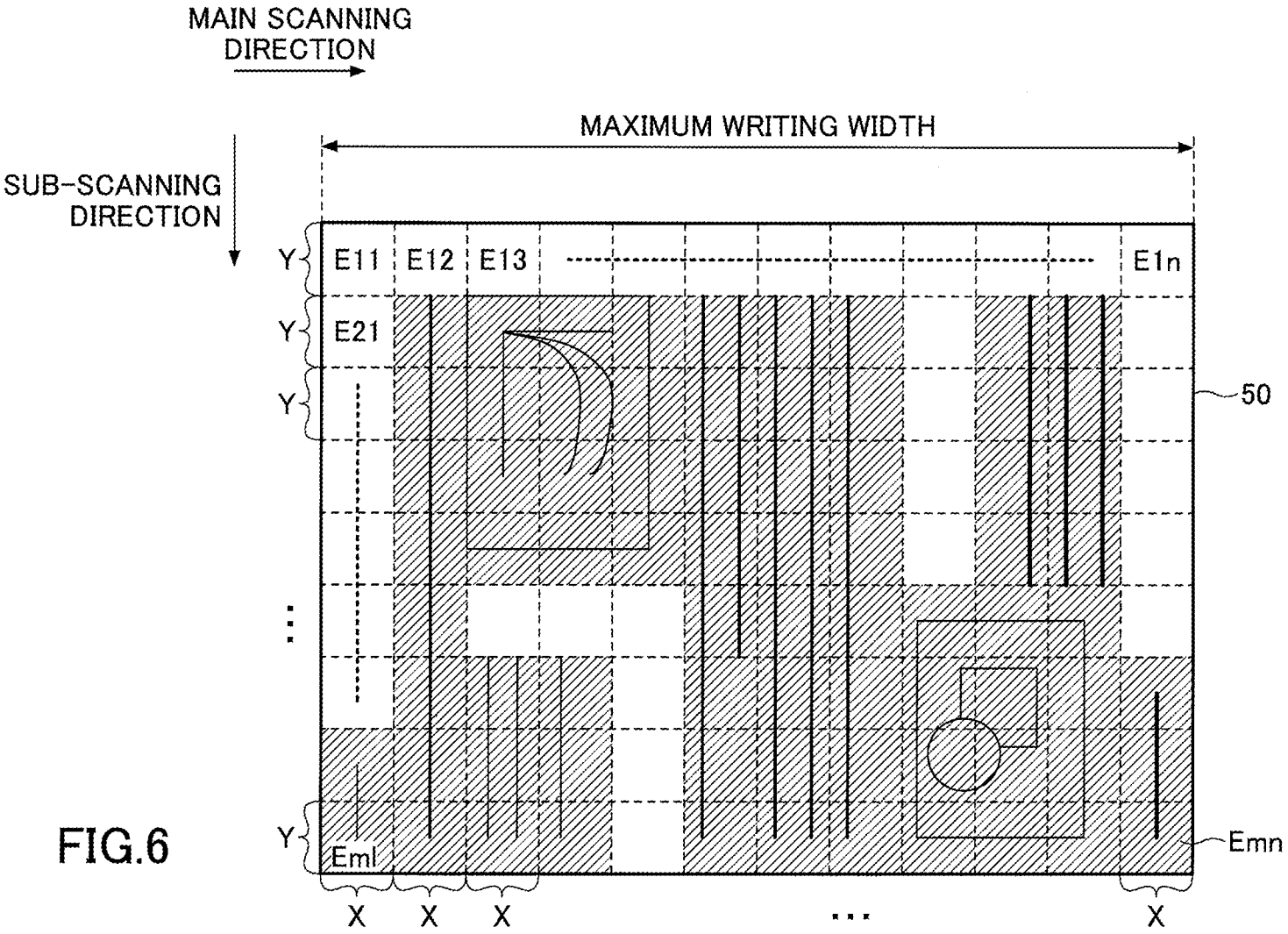
FIG. 6 is a diagram for explaining counting of pixels in a writing region.

Next, the counting of pixels by the pixel counting unit 243 according to this embodiment is explained. FIG. 6 is a diagram for explaining the counting of pixels in a writing region 50.

The pixel counting unit 243 determines the writing region 50 as being a matrix. Emn of m×n elements in which each element is represented by a predetermined area E, and counts the pixels in the predetermined area E corresponding to each matrix element. In this embodiment, it is assumed that the predetermined area E is a rectangular area of X×Y where X and Y denote lateral and vertical length values in millimeters, respectively.

In this embodiment, the register unit 244 of the writing control unit 235 includes a plurality of registers corresponding to the plurality of the predetermined areas E. In the example of FIG. 6, the writing region 50 includes the areas E11-Emn, and the register unit 244 includes the registers corresponding to the areas E11-Emn. A counted value of pixels in each of the areas E11-Emn counted by the pixel counting unit 243 is stored in a corresponding one of the registers.

The pixel counting unit 243 starts counting the pixels in the area at the upper left corner of the writing region 50 as a scan starting position. The main scan counting unit 245 of the pixel counting unit 243 counts the pixels in the area at the upper left corner of the writing region 50 in the main scanning direction. The main scan counting unit 245 stores the counted value of pixels in the corresponding register area by area.

For example, the main scan counting unit 245 counts the pixels in one of the main scanning lines in the area at the upper left corner of the writing region 50. The pixels counted at this time are the pixels included in one of the main scanning lines in the area E11. The main scan counting unit 245 stores a sum of the counted values for all the main scanning lines in the area E11 into the corresponding one of the plurality of registers. The main scan counting unit 245 stores the counted values of pixels in the area E11 into the corresponding register in an accumulated manner each time the length of X millimeters in the main scanning direction is reached to make the main scanning on one of the main scanning lines in the area E11. Thus, the value stored in the corresponding register is equal to a sum of the counted values of pixels forming the main scanning lines in the area E11.

Subsequently, the object of the pixel counting is shifted to the pixels included in the area E12, and the main scan counting unit 245 stores a sum of the counted values of pixels in the area E12 into the corresponding register for the area E12 in a similar manner. Thus, the value stored in the corresponding register is equal to a sum of the counted values of pixels forming the main scanning lines in the area E12.

While the main scan counting unit 245 performs pixel counting of one line of the areas E11-E1n (equivalent to the length of X×n millimeters) in the main scanning direction, the sub-scan counting unit 246 performs pixel counting of one line of the areas E11-Em1 (equivalent to the length of Y×m millimeters) in the sub-scanning direction. In this case, the number of scan lines counted is equal to 1. At this time, the sum of the counted values of pixels in each of the areas E11-E1n in the main scanning direction is stored in one of the registers corresponding to the areas E11-E1n.

After the pixel counting of one line of the writing region 50 is performed, the main scan counting unit 245 restarts counting the pixels in the area at the left end of the next line. The main scan counting unit 245 counts the pixels in the area at the left end of the next line in a similar manner.

When the pixel counting for the length of Y millimeters in the sub-scanning direction is performed by the sub-scan counting unit 246, the sums of the counted values of the pixels in the areas E11-E1n are stored in the registers corresponding to the areas E11-E1n. The same processing is performed for the area E21 and subsequent areas of the writing region 50 and the sum of the counted values of the pixels for each of the areas E11-Emn is obtained.

In this embodiment, the number of registers which is the same as the number of areas included in the writing region 50 may be included in the register unit 244. In this case, the number of registers in the register unit 244 is represented by the number of m×n. Alternatively, the number of registers which is the same as the number of areas included in the main scanning direction may be included in the register unit 244. In this case, when the counting of pixels in each of the areas E11-E1n is performed, the writing control unit 235 may temporarily store the values from the "n" registers in the RAM 221 and eliminate the values stored in all the "n" registers. The number of registers is determined depending on the width of the writing region 50 and the size of each area E. For example, when the maximum width of the writing region in the image forming apparatus 100 is set to W millimeters, it is sufficient that the number of the registers is greater than the quotient of W/X.

The counted value stored in each of the registers of the register unit 244 is used for the determination of presence or absence of the image for one of the areas and the computation of the heating amount of the heater **20*n***, which will be described later. Hence, it is desirable that the size of each register is the same as the size of an 8-bit register. It is desirable that the counted value is a value with a multi-level gradation.

In this embodiment, it is assumed that X=Y=2 millimeters. Hence, the writing region 50 is represented by a group of the areas of 2×2 millimeters.

In this embodiment, the value of X may be equal to a width in the main scanning direction of the heater **20*n* with the smallest width among the plurality of heaters 20*n*. The value of Y may be determined to satisfy the condition: $V>Y/t1$ where V denotes the transporting speed of the recording material in the image forming apparatus 100 and t1 denotes a heating response time of the heater 20*n*. The heating response time is a time taken after heating of the heater 20*n* is started until the temperature of the fixing roller 129 has reached a predetermined temperature at which toner may be fixed to the recording material. By determining the value of Y in this manner, the heating response time may be made sufficiently small relative to the transporting speed of the recording material and the temperature of the fixing roller 129** may reach the predetermined temperature suitably at the time of fixing.

Figure 7:
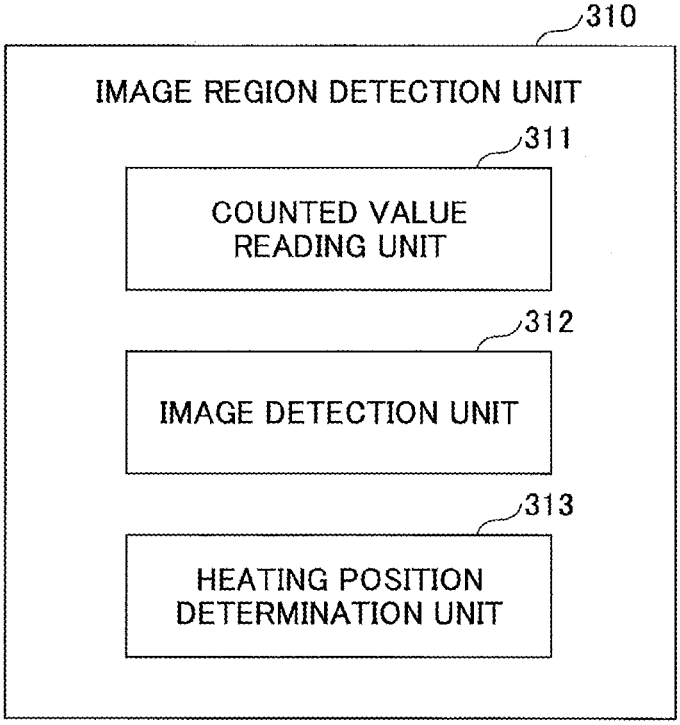
FIG. 7 is a diagram for explaining the functional composition of an image region detection unit according to the first embodiment.

Next, the functional composition of the image region detection unit 310 according to this embodiment is explained. FIG. 7 is a diagram for explaining the functional composition of the image region detection unit 310 according to the first embodiment.

The image region detection unit 310 includes a counted value reading unit 311, an image detection unit 312, and a heating position determination unit 313.

The counted value reading unit 311 is configured to read the sum of the counted values from the register unit 244 of the writing control unit 235. The sum of the counted values may be temporarily stored in the RAM 221 in the engine control unit 220.

The image detection unit 312 is configured to determine the presence or absence of the image in each of the plurality of the predetermined areas of the writing region 50. The details of the determination by the image detection unit 312 will be described later. The heating position determination unit 313 is configured to determine as a heating position the position of the heater 20*n* corresponding to the area in which the presence of the image is determined.

Figure 8:
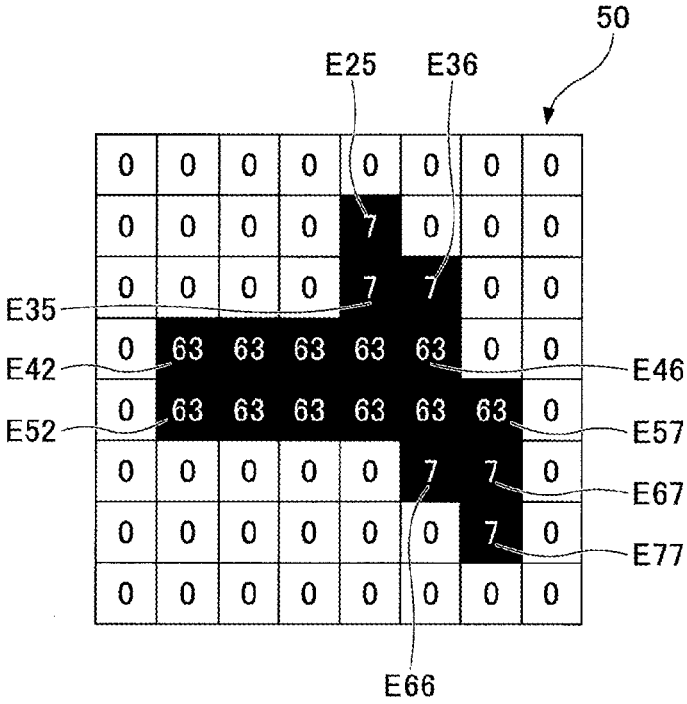
FIG. 8 is a diagram for explaining determination by an image detection unit according to the first embodiment.

Next, the determination as to the presence or absence of the image by the image detection unit 312 is explained. FIG. 8 is a diagram for explaining the determination by the image detection unit 312 according to the first embodiment. The image detection unit 312 is configured to determine the presence or absence of the image in each of the areas based on the value of the register in which the sum of the counted values of pixels is stored in each of the predetermined areas by the pixel counting unit 243.

Specifically, the image detection unit 312 determines the absence of the image in the corresponding area as being a non-image region in which no image is present when the value of the register is equal to 0. The image detection unit 312 determines the presence of the image in the corresponding area as being an image region in which the image is present when the value of the register is not equal to 0. The non-image region is equivalent to an area where an image (non-fixed toner image) does not exist and heating for fixing the image is not required. The image region is equivalent to an area where an image (non-fixed toner image) exists and heating for fixing the image by the heater 20*n* is required.

In this embodiment, when the value of the register (the sum of the counted values) is equal to 0, the corresponding area is determined as being a non-image region. Alternatively, the image detection unit 312 may be configured to determine the corresponding area as being a non-image region when the sum of the counted values is less than a predetermined value.

The heating position determination unit 313 is configured to determine the image region as the heating position. In the example of FIG. 8, the sum of the counted values of each of the areas E25, E35, E36, E66, E67 and E77 is equal to 7 and the sum of the counted values of each of the areas E42-E46 and E52-E57 is equal to 63. Hence, it can be understood that these areas are determined as being the image region. The heating position determination unit 313 determines the areas which coincide with these image regions as the heating positions.

After the heating position is determined, the heater selection unit 320 selects the heater 20*n* corresponding to the heating position so that the image region is heated by the selected heater 20*n*.

Figure 9:
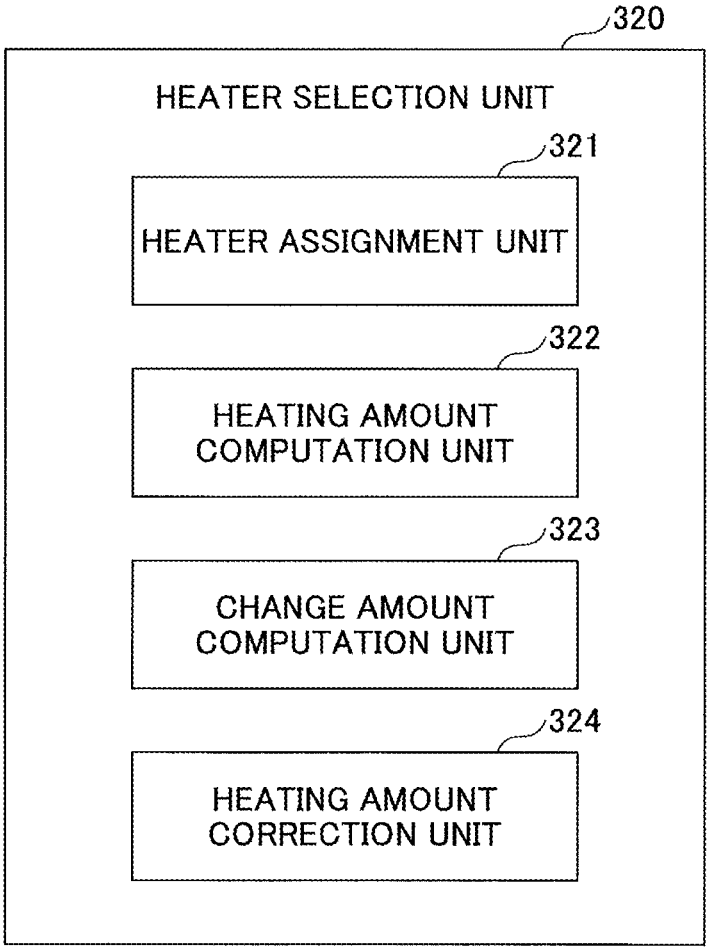
FIG. 9 is a diagram for explaining the functional composition of a heater selection unit according to the first embodiment.

Next, the heater selection unit 320 according to this embodiment is explained. FIG. 9 is a diagram for explaining the functional composition of the heater selection unit 320 according to the first embodiment. In the following, the sum of the counted values read from the register unit 244 by the counted value reading unit 311 will be referred to as the counted value.

The heater selection unit 320 includes a heater assignment unit 321, a heating amount computation unit 322, a change amount computation unit 323, and a heating amount correction unit 324.

The heater assignment unit 321 is configured to select from the plurality of heaters 20*n* the heater that heats the corresponding area of the writing region 50 for the heating position determined by the heating position determination unit 313.

The heating amount computation unit 322 is configured to compute a heating amount of the corresponding area based on the counted value of the corresponding area read by the counted value reading unit 311. Specifically, in the example of FIG. 8, there are the areas Emn the counted value of which is equal to 3 and the areas Emn the counted value of which is equal to 63. The counted value is increased when the number of pixels in the corresponding area Emn becomes great and the optical density of the image to be fixed becomes high. Hence, the heating amount computation unit 322 computes the heating amount based on the counted value of the area Emn corresponding to the heating position.

For example, a table in which the counted values and the heating amounts are associated with each other may be stored in the ROM 222, and the heating amount computation unit 322 may be configured to compute the heating amount by checking the content of the table.

The change amount computation unit 323 is configured to compute an amount of change of the heating amount between adjoining ones of the heating areas. When the amount of change of the heating amount computed by the change amount computation unit 323 is greater than or equal to a predetermined threshold, the heating amount correction unit 324 corrects the heating amounts of the adjoining heating areas so that the amount of change after the correction may be less than the threshold.

Figure 10:
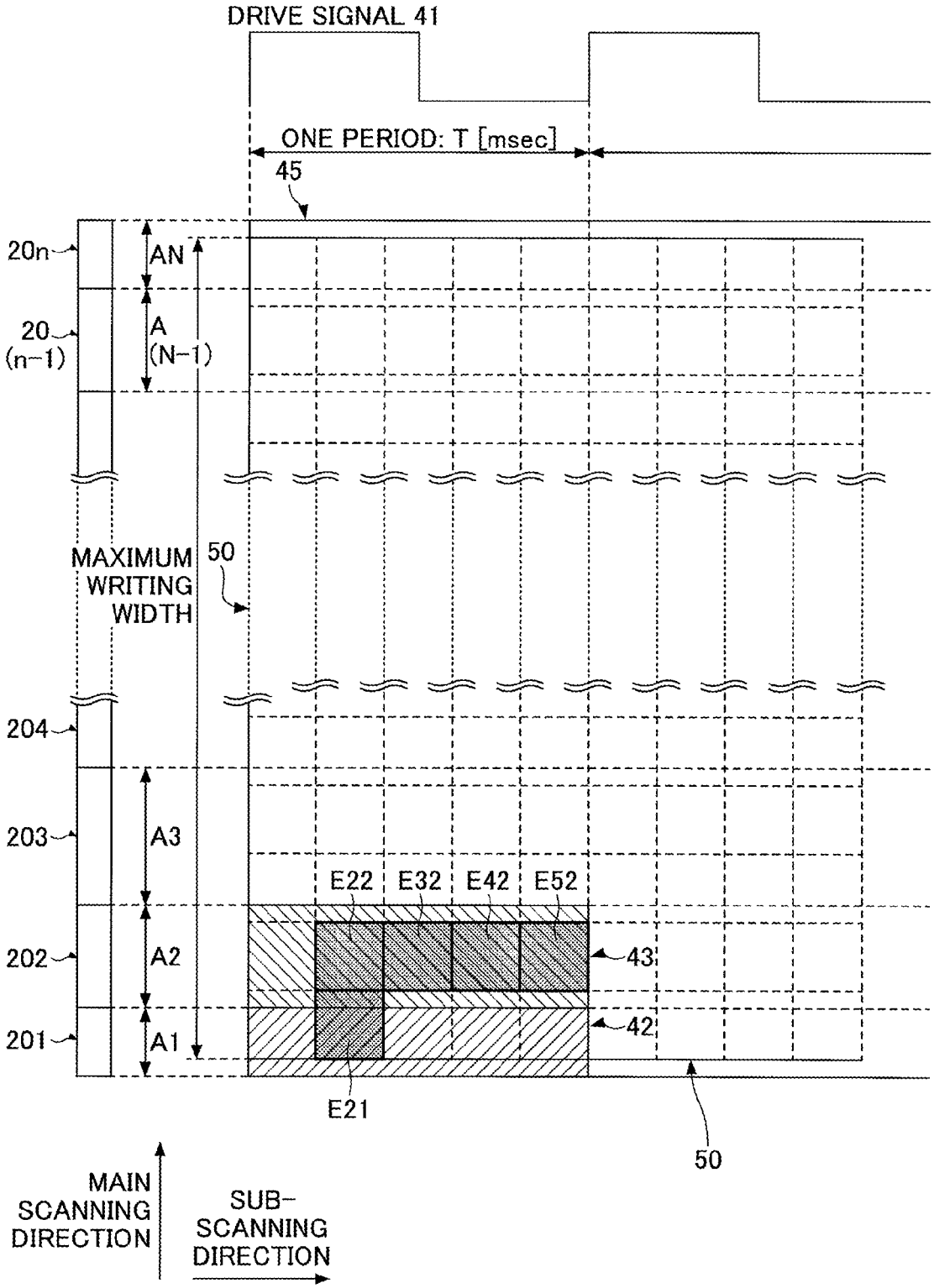
FIG. 10 is a diagram for explaining assignment of heaters and computation of a heating amount.

Next, the assignment of heaters by the heater assignment unit 321 and the computation of the heating amount by the heating amount computation unit 322 are explained. FIG. 10 is a diagram for explaining assignment of heaters and computation of a heating amount.

In FIG. 10, a conceptual diagram showing a state in which the writing region 50 which is divided into the plurality of areas Emn is superimposed on a fixing region 45 corresponding to the writing region 50 which is heated by the heaters 201-20*n* is illustrated.

In the example of FIG. 10, each of the areas E21, E22, E32, E42, and E52 of the writing region 50 is part of the image region, and the position of each of these areas is part of the heating position. For example, the area E21 is included in the heating area 42 heated by the heater 201 and included in the heating area 43 heated by the heater 202. Hence, the heater assignment unit 321 assigns the heaters 201 and 202 to the area E21. Moreover, each of the areas E22, E32, E42, and E52 of the writing region 50 is included in the heating area 43 heated by the heater 202. Hence, the heater assignment unit 321 assigns the heater 202 to the areas E22, E32, E42, and E52.

Next, the computation of the heating amount by the heating amount computation unit 322 of this embodiment is explained.

The heating amount computation unit 322 is configured to compute the heating amount according to the counted value corresponding to the area Emn included in the heating area.

In the example of FIG. 10, among the areas Emn included in the heating area 42, only the area E21 is the image region and corresponds to the counted value that is greater than 1. When the counted value corresponding to the area E21 is equal to 31, the heating amount computation unit 322 computes a heating amount of the heating area 42 corresponding to the counted value of 31.

Moreover, in the example of FIG. 10, among the areas Emn included in the heating area 43, each of the areas E21, E22, E32, E42, and E52 is the image region and corresponds to the counted value that is greater than 1. The heating amount computation unit 322 obtains a sum of the counted values of the areas E21, E22, E32, E42, and E52 and computes a heating amount of the heating area 43 by the heating amount corresponding to the sum of the counted values. For example, when the sum of the counted values of the areas E21, E22, E32, E42, and E52 is equal to 255, the heating amount computation unit 322 computes a heating amount corresponding to the counted value that is equal to 255, as the heating amount of the heating area 43.

In this case, the heating amount of the heating area 43 is greater than the heating amount of the heating area 42. The change amount computation unit 323 computes an amount of change of the heating amount between the adjacent heating areas in which the heating amounts differ from each other. The heating amount correction unit 324 corrects the heating amounts of the adjacent heating areas. The details of processing of the change amount computation unit 323 and the heating amount correction unit 324 will be described later.

In this embodiment, the heating areas 42 and 43 are adjacent to each other. In the actual fixing control, the heating areas 42 and 43 are divided also in the sub-scanning direction according to the movement of the heater 20*n* according to the rotational speed of the fixing roller 129.

As described above, the heating amount computation unit 322 computes the heating amount for each of the heating areas based on the presence of the image in the heating area and the density of the image. Moreover, the heating amount computation unit 322 may be configured to adjust the heating amount according to the type of the recording material or the like.

In the example of FIG. 10, the plurality of areas Emn is included in the heating area. However, the present disclosure is not limited to this example. For example, the heating area may correspond to the areas Emn obtained by division of the writing region 50 by reducing the period of the drive signal 41. In this case, only one of the areas Emn is included in one heating area.

Figures 11A, 11B:
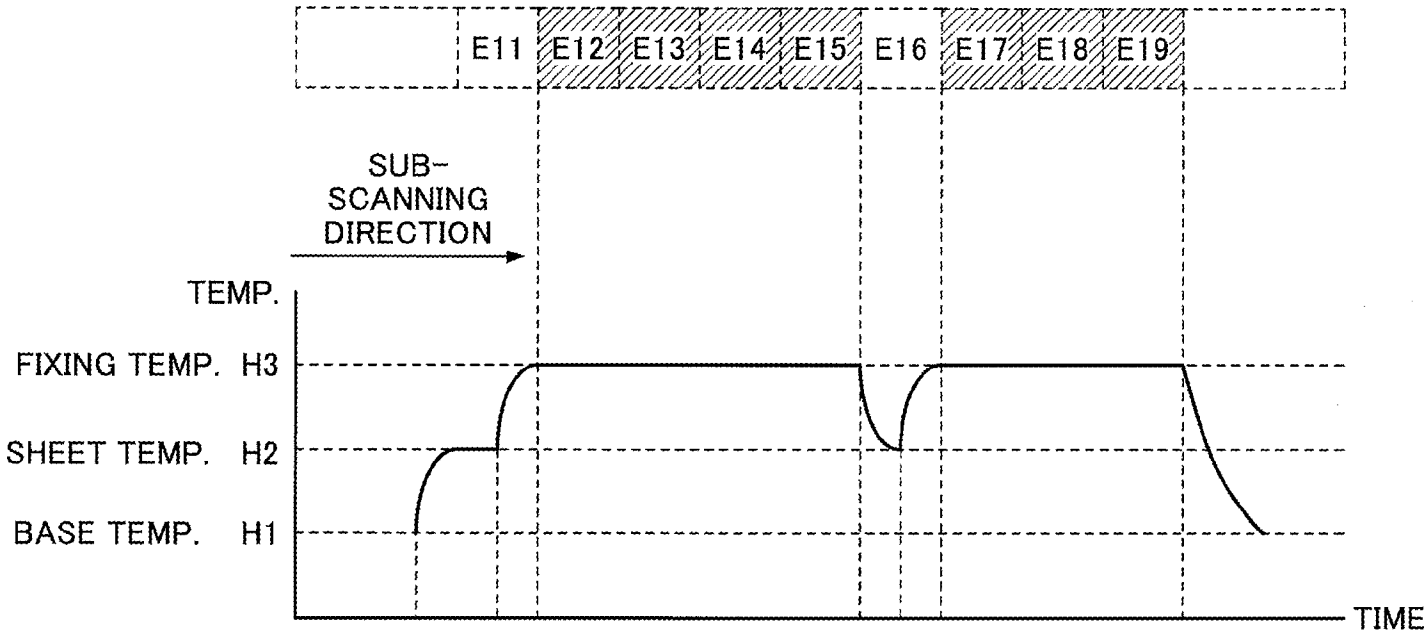
FIG. 11A and FIG. 11B are diagrams for explaining temperature control of the fixing device during image formation.

Next, temperature control of the fixing device 128 when image formation is performed by the image forming apparatus 100 according to this embodiment is explained. FIG. 11A and FIG. 11B are diagrams for explaining the temperature control of the fixing device during image formation.

When the fixing is performed by the fixing device 128, the fixing control unit 350 of the image forming apparatus 100 performs the temperature control by setting three temperature ranges in advance by using the heater drive unit 330. The three temperature ranges include a base temperature range, a sheet temperature range, and a fixing temperature range. The base temperature range is a range of temperatures not higher than a base temperature H1. When the image forming apparatus 100 does not perform image formation, the heater portion 200 including the plurality of heaters 20*n* is held at a temperature within the base temperature range. In this embodiment, a temperature sensor to detect a temperature of the heater portion 200 is arranged, and the temperature of the heater portion 200 is detected using the temperature sensor by activating a heater temperature monitoring function provided in the image forming apparatus 100.

The sheet temperature range is a range of temperatures not higher than a sheet temperature H2 which is higher than the base temperature H1. When a print request is received by the image forming apparatus 100, the heater portion 200 is heated to a temperature within the sheet temperature range. The heater portion 200 is heated so that the temperature of the heater portion 200 may be increased to the sheet temperature H2 when the recording material is detected. The sheet temperature H2 may vary within the sheet temperature range depending on the type of the recording material.

The fixing temperature range is a range of temperatures higher than the sheet temperature H2. When the fixing is started during image formation, only the heaters 20*n* selected from among the plurality of heaters 20*n* in the heater portion 200 are activated and the temperature of the selected heaters is increased to a fixing temperature H3.

In this embodiment, the plurality of heaters 20*n* in the heater portion 200 is initially activated to reach the sheet temperature H2. When the fixing is performed, only the selected heaters 20*n* are further activated and the temperature of the selected heaters is increased to the fixing temperature H3. The fixing temperature H3 may vary within the fixing temperature range depending on the density of the image being fixed and the type of the recording material.

FIG. 11A shows an example of areas of an image based on image data and FIG. 11B shows an example of changes of the temperature of the heater portion 200 within a fixed time period. In the example of FIG. 11A, each of the areas E12-E15 and E17-E19 is the image region. Hence, the heaters 20*n* to heat the areas E12-E15 and E17-E19 are activated to the fixing temperature H3. Each of other areas E11 and E16 is the non-image region. Hence, the heaters 20*n* corresponding to the areas E11 and E16 are maintained at a temperature under the sheet temperature H2.

Figure 12:
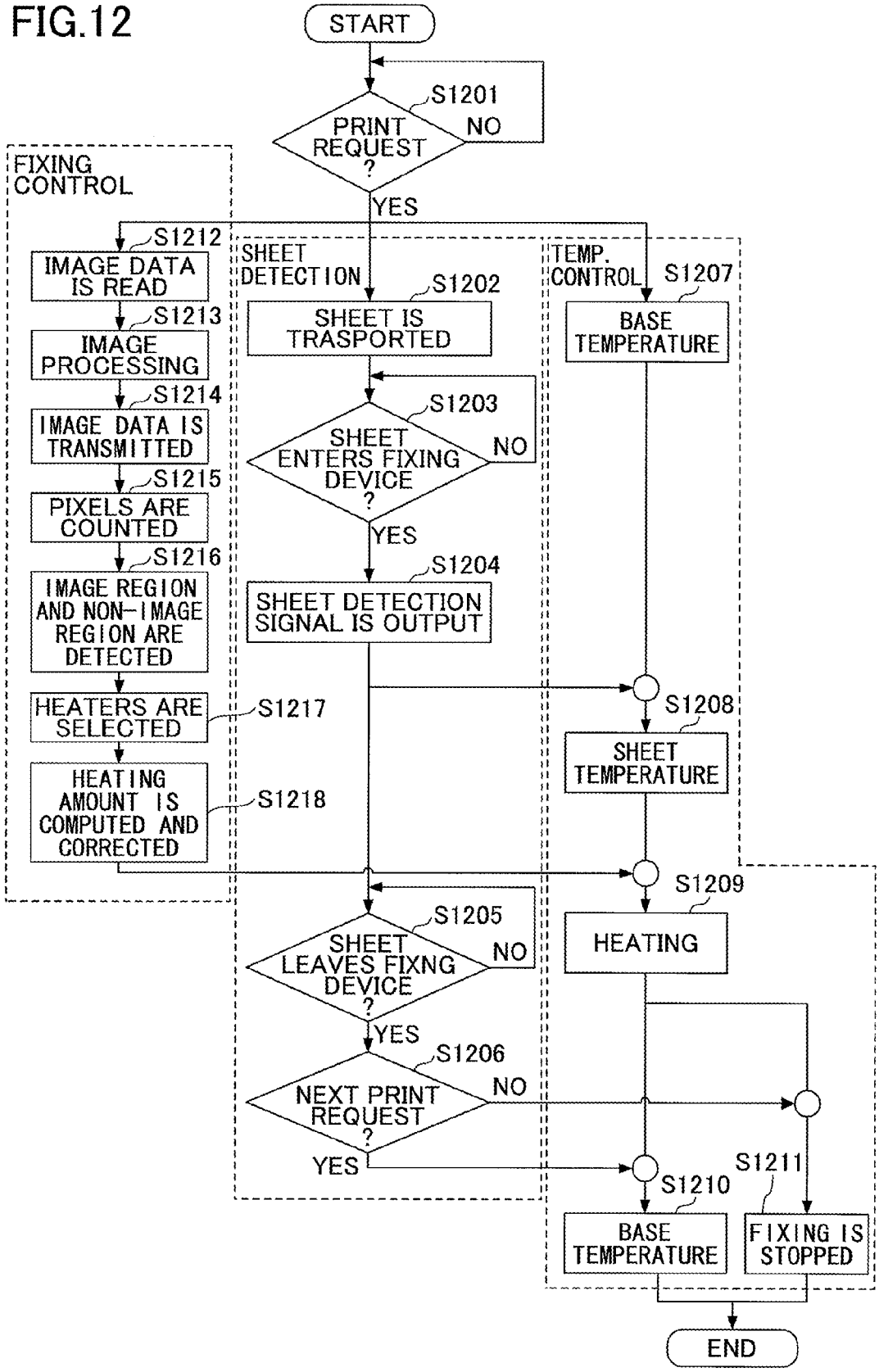
FIG. 12 is a flowchart explaining operation of the image forming apparatus according to the first embodiment.

Next, operation of the image forming apparatus 100 according to this embodiment is explained. FIG. 12 is a flowchart explaining operation of the image forming apparatus according to the first embodiment.

When a print request is received (step S1201), the image forming apparatus 100 performs processing of fixing control, processing of recording material detection, and processing of temperature control in parallel. The processing of fixing control is performed by the controller 210 and the fixing control unit 350 of the CPU 300. The processing of temperature control is performed by the fixing control unit 350 of the CPU 300. The processing of recording material detection is performed by the electric control unit 223.

First, the processing of recording material detection is explained. In the image forming apparatus 100, the electric control unit 223 starts transporting of a recording material (or a sheet) (step S1202). Subsequently, the electric control unit 223 determines whether the recording material enters the fixing device 128 (step S1203). For example, an arrival detection sensor which detects arrival of the recording material is arranged in the fixing device 128, and the arrival of the recording material at the fixing device 128 may be detected by using the arrival detection sensor.

When it is determined in step S1203 that the recording material enters the fixing device 128, the electric control unit 223 outputs a recording material detection signal to the CPU 300 (step S1204). When the recording material is detected, the fixing control unit 350 of the CPU 300 starts performing step S1208 which will be described later.

Moreover, when the recording material is detected, the electric control unit 223 determines whether the recording material leaves the fixing device 128 (step S1205). For example, a passage detection sensor to detect the passage of the recording material through the fixing device 128 may be arranged. Using the output of the passage detection sensor, the electric control unit 223 may determine the passage of the recording material through the fixing device 128.

When the recording material is determined as leaving the fixing device 128 in step S1205, the electric control unit 223 detects whether a next print request is received (step S1206). When the next print request is detected as being received in step S1206, the control progresses to step S1210 which will be described later. On the other hand, when the next print request is detected as being not received in step S1206, the control progresses to step S1211 which will be described later.

Next, the processing of temperature control is explained. When the print request is received, the fixing control unit 350 causes the heater drive unit 330 to activate the heater portion 200 so that the temperature of the heater portion 200 is raised to the base temperature H1 (step S1207). Because of the reception of the print request, the fixing control unit 350 causes the heater drive unit 330 to further activate the heater portion 200 so that the temperature of the heater portion 200 is raised to the sheet temperature H2 (step S1208).

Subsequently, the fixing control unit 350 causes the heater drive unit 330 to activate the heaters 20*n*, which are selected in step S1217 (described later) and in which the heating amount is corrected in step S1218 (described later), based on the heating amount after the correction (step S1209). If the selected heaters 20*n* heat the recording material to the fixing temperature H3 according to the image density, the non-fixed toner image is fixed to the recording material.

Subsequently, the fixing control unit 350 maintains the temperature of the heater portion 200 at the base temperature H1 when the next print request is received (step S1210). When no next print request is received, the fixing control unit 350 stops the activation of the heater portion 200 the heater drive unit 330 so that the fixing is stopped (step S1211).

Next, the processing of fixing control is explained. The processing of fixing control includes processing of the heating amount computation control that computes the heating amount for each of the heating areas.

The controller 210 of the image forming apparatus 100 reads the image data (step S1212). Subsequently, the controller 210 causes the image processing unit 214 to perform image processing on the read image data (step S1213). The image processing by the image processing unit 214 is needed for the printer unit 120 to output the image data.

Subsequently, the controller 210 transmits the image data after the image processing to the writing control unit 235 (step S1214). Subsequently, the writing control unit 235 generates a light-on control signal based on the image data, generates an electrostatic latent image to be written on the photoconductor drum 121, controls the pixel counting unit 243 to count the pixels, and determines the writing region 50 as being a matrix of the predetermined areas (step S1215). In other words, the writing control unit 235 divides the writing region 50 into the areas. The counting of pixels by the pixel counting unit 243 has already been described above.

Subsequently, the image region detection unit 310 of the fixing control unit 350 causes the counted value reading unit 311 to read the counted value from the writing control unit 235, and causes the image detection unit 312 to detect whether a target area is the image region or the non-image region for each of the areas of the writing region 50 (step S1216).

Subsequently, the heater selection unit 320 of the fixing control unit 350 selects the heaters 20*n* to which the image region is assigned by the heater assignment unit 321 (step S1217). Subsequently, the heater selection unit 320 corrects the heating amount based on the computation result of the heating amount of each of the heaters 20*n* computed by the heating amount computation unit 322 (step S1218). The control progresses to step S1209.

Figure 13:
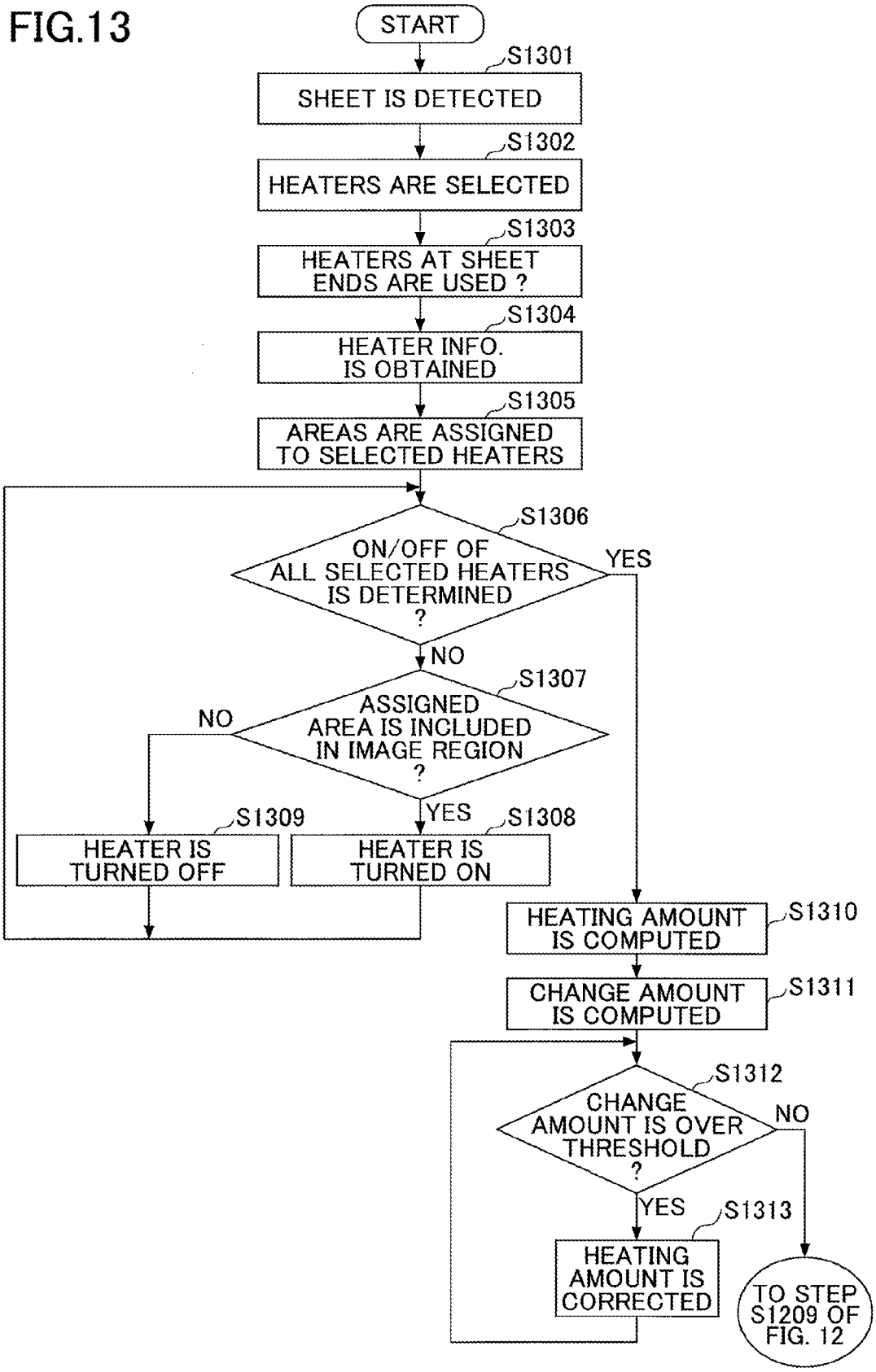
FIG. 13 is a flowchart for explaining processing of the heater selection unit according to the first embodiment.

Next, the processing of the heater selection unit 320 according to this embodiment is explained. FIG. 13 is a flowchart for explaining processing of the heater selection unit according to the first embodiment. The flowchart of FIG. 13 depicts the details of the processing of steps S1217 and S1218 in the flowchart of FIG. 12.

In the flowchart of FIG. 13, processing of steps S1301 to S1309 depicts the details of processing of step S1217 in FIG. 12, and processing of steps S1310 to S1312 depicts the details of processing of step S1218 in FIG. 12.

As shown in FIG. 13, the heater selection unit 320 detects the width of the recording material (step S1301). For example, the width of the recording material may be detected by the arrival detection sensor, arranged in the fixing device 128, when the recording material reaches the fixing device 128.

Subsequently, the heater selection unit 320 selects the heaters 20*n* used according to the width of the recording material (step S1302). For example, when the recording material is disposed at the center portion of the heater portion 200 and the recording material is not present at the ends of the heater portion 200, the corresponding heaters 20*n* at the positions where the recording material is not present are not used. For example, in the heater portion 200 shown in FIG. 2B, when the recording material is not present at the positions corresponding to the heaters 201 and 20*n*, the heater selection unit 320 selects the heaters other than the heaters 201 and 20*n* as the heaters to be used.

Subsequently, the heater selection unit 320 determines whether the heaters 20*n* located at the ends of the recording material are used (step S1303). For example, there may be a case in which an image is concentrated in the center of a recording material and the image is not present at the end portions of the recording material. In this case, it is not necessary to activate the heaters 20*n* located at the end of the recording material. Whether the heaters 20*n* located at the ends of the recording material are used may be determined in advance by user's setting.

For example, when the user's setting is to use the heaters 20*n* located at the ends of the recording material, the heater selection unit 320 uses all the heaters 20*n* selected in step S1302. When the user's setting is not to use the heaters 20*n* located at the ends of the recording material, the heater selection unit 320 does not select the corresponding heaters 20*n*.

Subsequently, the heater selection unit 320 obtains the heater information 22 (FIG. 3) from the ROM 222 (step S1304). Specifically, the heater information 22 relates to the heater portion 200 and contains a width, an arrangement, a temperature increase rate and a temperature decrease rate (due to rotation of the fixing belt 138) of each of the heaters 20*n*.

Subsequently, the heater selection unit 320 checks the heater information 22 of the heaters 20*n* which are selected in steps S1302 and S1303 and assigns the areas Emn of the writing region 50 to the heaters 20*n* (step S1305). When assigning the areas Emn to the heaters 20*n*, the heater selection unit 320 primarily checks the width and the arrangement of the heaters 20*n* included in the heater information 22.

Figure 14:
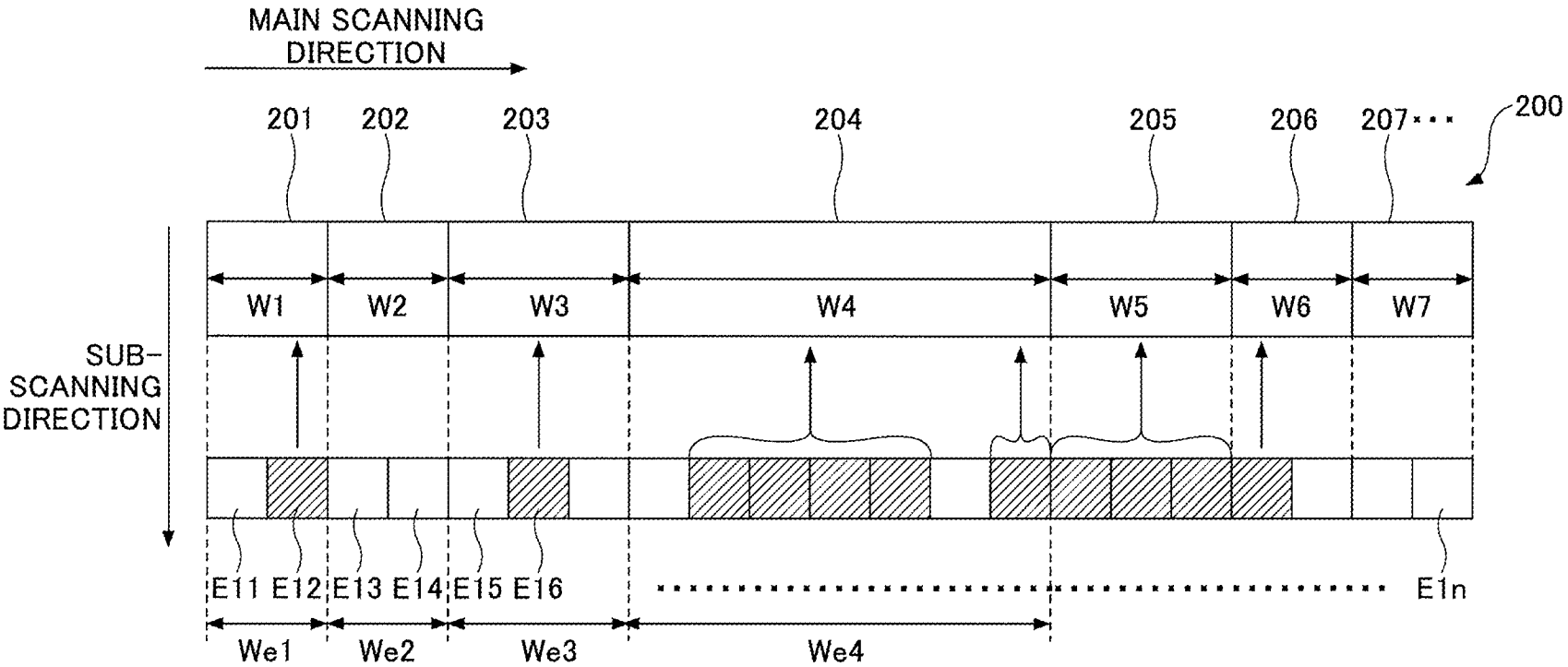
FIG. 14 is a diagram for explaining assignment of areas in a writing region to heaters.

Next, the assignment of the areas of the writing region 50 to the heaters 20*n* is explained. FIG. 14 is a diagram for explaining the assignment of the areas of the writing region to the heaters.

In FIG. 14, a case in which the heaters 201-207 in the heater portion 200 are selected as the heaters being used is illustrated. In the case of FIG. 14, the areas E11-E1n are assigned to the heater portion 200.

The heater selection unit 320 determines the position of the area E11 in the writing region 50 in the main scanning direction and the sub-scanning direction based on the address of the register in which the counted value of the area E11 is stored. The heater selection unit 320 determines which heaters 20*n* in should be selected to heat the area E11 based on the position of the area E11.

For example, the heater in the heater portion 200 at the position corresponding to the area E11 in the writing region 50 is the heater 201. Hence, the heater selection unit 320 assigns the area E11 to the heater 201. Next, the heater selection unit 320 determines whether a total width We1 of the area E11 and the area E12 is less than or equal to a width W1 of the heater 201. When the total width We1≤the width W1, the heater selection unit 320 also assigns the area E12 to the heater 201. In this way, the heater selection unit 320 assigns the areas to the heaters 20*n* based on the widths WN of the heaters 20*n* and the widths of the areas in the main scanning direction as described above.

For example, in the case of FIG. 14, a total width We2 of the areas E13 and E14 in the main scanning direction is less than or equal to a width W2 of the heater 202, and the heater selection unit 320 assigns the areas E13 and E14 to the heater 202. Similarly, the heater selection unit 320 assigns the areas E15-E17 to the heater 203. In this way, the heater selection unit 320 assigns all the areas included in the writing region 50 to the heaters 20*n* as described above.

Subsequently, the heater selection unit 320 determines whether turning ON and OFF of all the heaters 20*n* has been determined (step S1306). Turning ON the heaters 20*n* means increasing the temperature of the heaters 20*n* at the sheet temperature H2 to the fixing temperature H3. Turning OFF the heaters 20*n* means maintaining the temperature of the heaters 20*n* at the sheet temperature H2 without being increased to the fixing temperature H3.

When turning ON and OFF of all the heaters 20*n* has not been determined in step S1306, the control of the fixing control unit 350 progresses to step S1307. When turning ON and OFF of all the heaters 20*n* has been determined in step S1306, the control of the fixing control unit 350 progresses to step S1310 (described later).

The heater selection unit 320 determines whether any of the areas Emn assigned to the heaters 20*n* is included in the image region (step S1307). When the assigned area Emn is included in the image region in step S1307, the heater selection unit 320 selects the heaters 20*n* as the heaters being turned ON (step S1308), and the control is returned to step S1306. On the other hand, when none of the assigned areas Emn is included in the image region in step S1307, the heater selection unit 320 regards the heaters 20*n* as the heaters being turned OFF (step S1309), and the control is returned to step S1306.

When turning ON and OFF of all the heaters 20*n* has been determined in step S1306, the heating amount computation unit 322 of the heater selection unit 320 computes the heating amount of the heating area corresponding to each of the heaters 20*n* area by area (step S1310). The heating amount computation unit 322 computes the heating amounts of all the heating areas.

Subsequently, the change amount computation unit 323 of the heater selection unit 320 computes the amount of change of the heating amount between adjoining heating areas of the heating areas (step S1311). For example, the change amount computation unit 323 is configured to compute the amount of change of the heating amount between the adjoining heating areas in the sub-scanning direction.

Subsequently, the heating amount correction unit 324 determines whether the heating amount between the adjoining heating areas in the sub-scanning direction is greater than or equal to the predetermined threshold (step S1312).

When the amount of change is greater than or equal to the threshold in step S1312, the heating amount correction unit 324 corrects the heating amounts of the adjoining heating areas so that the amount of change after the correction is less than the threshold (step S1313), and the control is returned to step S1312. The details of the correction of the heating amounts will be described later.

When the amount of change is less than the threshold in step S1312, the control of the fixing control unit 350 progresses to step S1209 in FIG. 12.

Figure 15A:
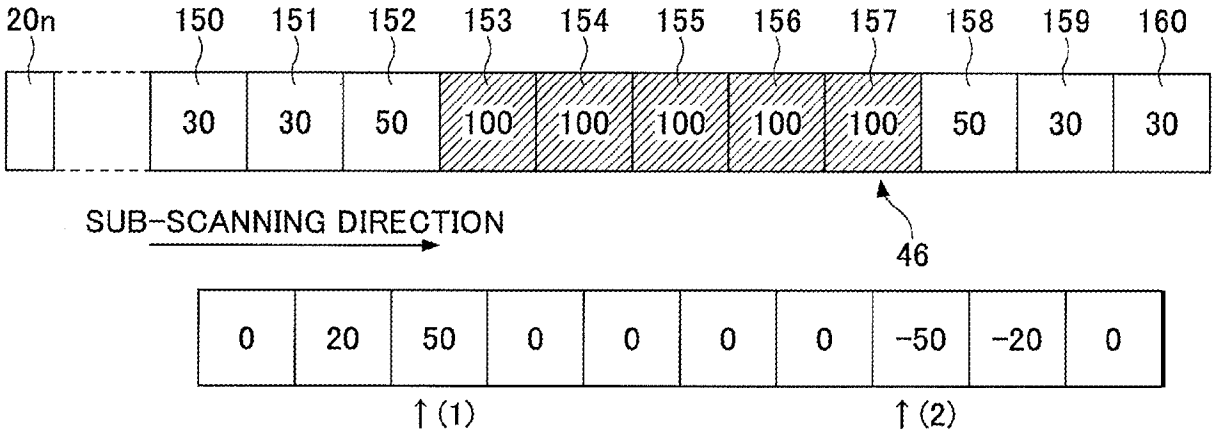
FIG. 15A and FIG. 15B are diagrams for explaining change of heating amount.
Figure 15B:
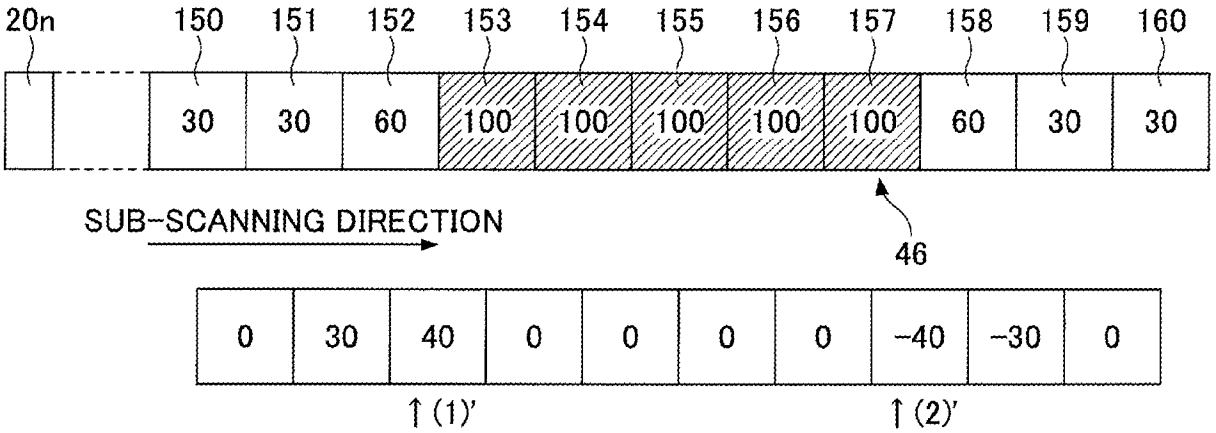

Next, the change of the heating amount of the heater 20*n* is explained. FIG. 15A and FIG. 15B are diagrams for explaining the change of the heating amount. FIG. 15A shows the heating amounts of the heating areas 150-160 corresponding to the heater 20*n* before the correction, and the respective amounts of change of the heating amount between adjoining ones of the heating areas in the sub-scanning direction. FIG. 15B shows the heating amounts of the heating areas 150-160 corresponding to the heater 20*n* after the correction, and the respective amounts of change of the heating amount between adjoining ones of the heating areas in the sub-scanning direction. In the case of FIGS. 15A and 15B, the correction of the heating amount with respect to a single heater 20*n* is explained.

The heating areas 150-160 in FIGS. 15A and 15B are illustrated as a fixing region 46 in which an image is fixed by the heating by the heater 20*n* when the heater 20*n* is activated by a drive signal 41 of one period T ms in the sub-scanning direction.

In the example of FIGS. 15A and 15B, it is assumed that the heating amount of the heater 20*n* to increase the temperature of the heater 20*n* to the base temperature H1 is set to 30, the heating amount of the heater 20*n* to increase the temperature of the heater 20*n* to the sheet temperature H2 is set to 50, and the heating amount of the heater 20*n* to increase the temperature of the heater 20*n* to the fixing temperature H3 is set to 100. In this example, the heating amount is represented by the numerical value. The heating amount may be represented by an amount of electric power needed to increase the temperature of the heater 20*n* to a target temperature.

In the example of FIGS. 15A and 15B, the image region exists in the heating areas 153-157 of the heater 20*n* included in the fixing region 46. Namely, the areas Emn in the writing region 50 in which the counted value of pixels is greater than or equal to 1 are included in the heating areas 153-157.

In the example of FIG. 15A, the heating amounts are computed such that the temperature of the heating areas 150, 151, 159, 160 is set to the base temperature H1, the temperature of the heating areas 152, 158 is set to the sheet temperature H2, and the temperature of the heating areas 153-157 is set to the fixing temperature H3. The value indicating the heating amount computed for each of the heating areas may be temporarily stored in the RAM 221.

The change amount computation unit 323 computes the amount of change (difference) of the heating amount between the adjoining heating areas in the sub-scanning direction area by area. Namely, the change amount computation unit 323 computes a difference between a heating amount of the heater 20*n* by a drive signal of an N-th period and a heating amount of the heater 20*n* by a drive signal of an (N+1)-th period where N denotes an integer.

In the example of FIG. 15A, the value indicating the heating amount of the heating area 151 is the same as the value indicating the heating amount of the heating area 150, and the amount of change of the heating amount between the adjoining heating areas 150 and 151 is equal to 0. Moreover, the amount of change between the value indicating the heating amount of the heating area 151 and the value indicating the heating amount of the heating area 152 is equal to 20, and the amount of change between the value indicating the heating amount of the heating area 152 and the value indicating the heating amount of the heating area 153 is equal to 50.

The amount of change between the adjoining heating areas may be temporarily stored in the RAM 221 together with the information which identifies the adjoining heating areas. In the case of FIG. 15A, 0 is stored as the amount of change between the heating areas 150 and 151, and 30 is stored as the amount of change between the heating areas 151 and 152. This is the same for other amounts of change between the heating areas.

Next, a case in which the threshold for the amount of change is set to 50 is explained. The threshold for the heating amount is set to a value obtained by experiments or experience. The threshold for the heating amount indicates a value needed for preventing the occurrence of flicker. In the example of FIG. 15A, the amount of change between the heating areas 152 and 153 and the amount of change between the heating areas 157 and 158 are greater than or equal to the threshold of 50.

As shown in FIG. 15B, the heating amount correction unit 324 corrects the heating amount so that the amount of change after the correction is less than 50. The heating amount correction unit 324 corrects the heating amount of the heating area 152 to 60 so that the amount of change of the heating amount between the heating areas 152 and 153 after the correction is less than the threshold of 50. Moreover, the heating amount correction unit 324 corrects the heating amount of the heating area 158 to 60 so that the amount of change of the heating amount between the heating areas 157 and 158 after the correction is less than the threshold of 50.

As described above, the heating amount correction unit 324 makes the amount of change less than the threshold by increasing the heating amount. The amount of change is corrected without reducing the heating amount of the heating area, and the occurrence of poor fixing in the heating area may be prevented and good fixing performance may be secured. The amount of change may be made less than the predetermined threshold, and the occurrence of flicker may be prevented.

Figure 16:
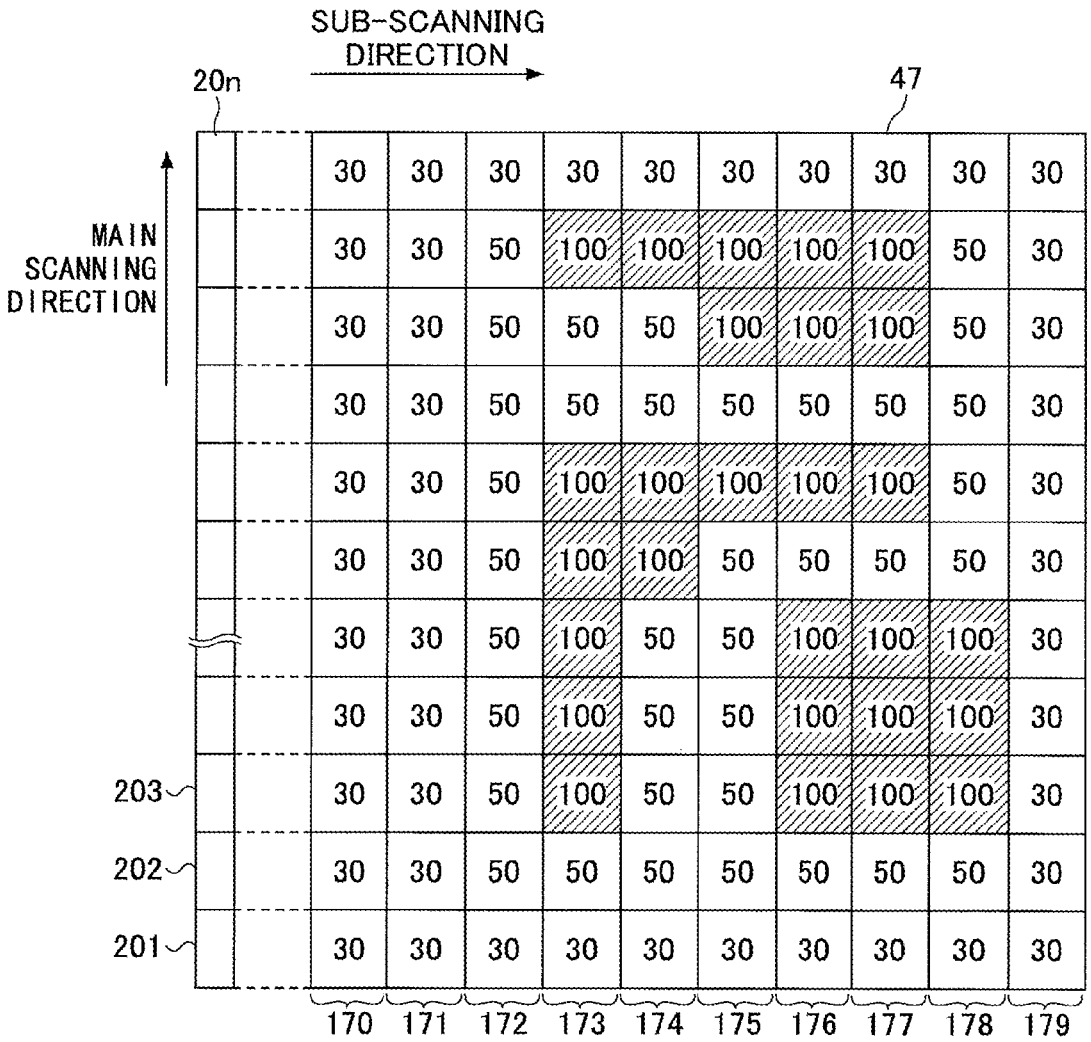
FIG. 16 is a diagram for explaining change of heating amount.

FIG. 16 is a diagram for explaining the change of the heating amount. In the example of FIG. 16, the correction of the heating amount with respect to two or more heaters 201-20*n* arranged in the main scanning direction is explained.

In FIG. 16, a fixing region 47 in which an image is fixed by the heating by the heaters 201-20*n* is illustrated. In the fixing region 47, a heating area heated by each of the heaters 201-20*n* according to the drive signal of one period is included.

The heating amount computation unit 322 computes a heating amount of the heating area for each of the heaters 201-20*n*. Then, the heating amount computation unit 322 obtains a sum of the heating amounts for the heating areas which are arrayed in a line in the main scanning direction, and computes the respective sums of the heating amounts for the rows of the heating areas arrayed in the sub-scanning direction.

In the example of FIG. 16, it is assumed that the sum of the heating amounts for a first row 170 of the heating areas in the sub-scanning direction is set to 330, the sum of the heating amounts for a second row 171 of the heating areas in the sub-scanning direction is set to 330, and the sum of the heating amounts for a third row 172 of the heating areas in the sub-scanning direction is set to 510. In this embodiment, the sum of the heating amounts for each of the rows of the heating areas arrayed in the sub-scanning direction is computed, and the heating amount is corrected so that the amount of change of the sum of the heating amounts between the adjoining rows after the correction is less than the threshold. The threshold for correcting the change of the sum of the heating amounts is set up as the threshold at this time. The value of this threshold may be obtained by experiments or experience. The threshold at this time indicates a value needed for preventing the occurrence of flicker.

Next, a case in which the threshold for changing the sum of the heating amounts is set to 200 is explained. In the example of FIG. 16, the amount of change between the sum of the heating amounts for the third row 172 and the sum of the heating amounts for the fourth row 173 is greater than or equal to the threshold of 200. Hence, the heating amount correction unit 324 corrects the heating amount of the heating area included in the third row 172 or the heating amount of the heating area contained in the fourth row 173 so that the amount of change after the correction is less than the threshold. At this time, the heating amount correction unit 324 may correct both the heating amount of the heating area included in the third row 172 and the heating amount of the heating area included in the fourth row.

Moreover, in the example of FIG. 16, the amount of change between the sum of the heating amounts for the ninth row 178 and the sum of the heating amounts for the tenth row 179 is greater than or equal to the threshold of 200. Similarly, in this case, the heating amount correction unit 324 corrects the heating amount of the heating area included in the ninth row 178 and the heating amount of the heating area included in the tenth row 179 so that the amount of change after the correction is less than the threshold.

For example, when the two or more heaters 201-20*n* are arrayed in the main scanning direction, the assignment of the heating amount to each heating area may be determined depending on the use of the image forming apparatus 100. The heating amount may be controlled so that the number of times of turning ON and OFF of the heaters 201-20*n* is reduced. In this case, the electric consumption of the heaters 201-20*n* may be reduced and the usable service life of the heaters 201-20*n* may be increased. The heating area following the heating area where the heater 20*n* is turned ON may be heated in advance. In this case, good fixing performance and productivity may be provided.

As described above, the heating amounts of the heating areas are corrected so that the amount of change of the heating amounts at the time of image formation may be less than the predetermined threshold, and the occurrence of flicker may be prevented without causing poor fixing.

Moreover, the writing region of an image is taken as a group of the predetermined areas Emn, and each area is assigned to the heaters. Hence, the areas may be assigned to the heaters if the heater information 22 is stored in the ROM 222 even when the configuration and the number of the heaters change. Therefore, the fixing control device according to this embodiment is applicable regardless of the configuration and composition of the heaters, and flexibility may be increased.

Moreover, only the heaters 20*n* assigned to the areas Emn are activated to heat the image to the fixing temperature. Hence, the electric power needed for the fixing may be reduced and the toner may be fixed efficiently.

Second Embodiment

Next, a description will be given of a second embodiment. The second embodiment differs from the first embodiment in that an image region in which an image is formed is made based on image data received from the controller 210. In the following, only the features of the second embodiment differing from the first embodiment are explained. The elements in the second embodiment which are the same as corresponding elements in the first embodiment are designated by the same reference numerals, and a description thereof will be omitted.

Figure 17:
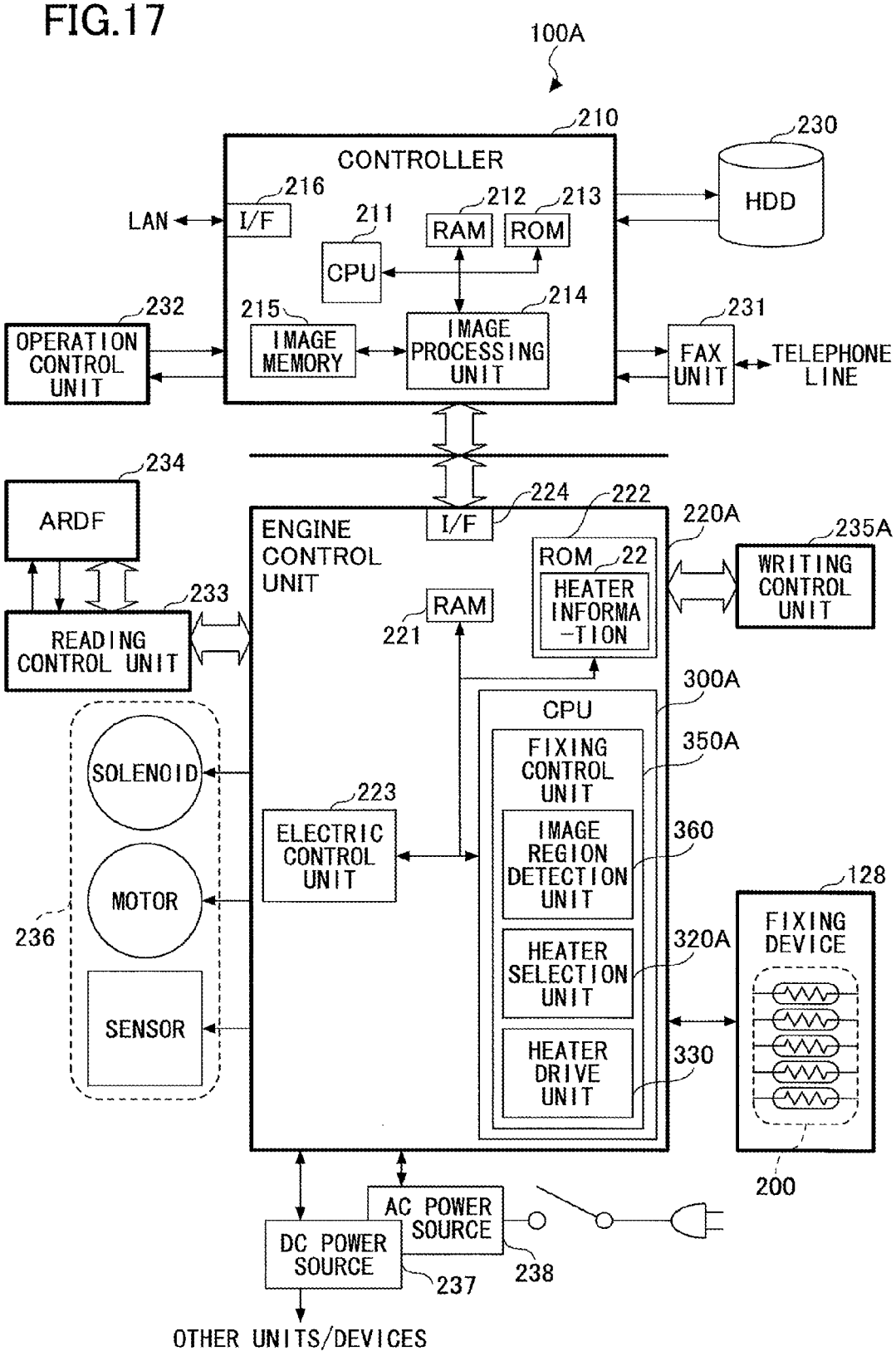
FIG. 17 is a diagram for explaining the composition of an image forming apparatus according to a second embodiment.

FIG. 17 shows the composition of an image forming apparatus 100A according to the second embodiment. The image forming apparatus 100A includes a writing control unit 235A and a CPU 300A. The writing control unit 235A transmits the image data, received from the controller 210 or the reading control unit 233 via the PCI bus, to an LD (laser diode) unit or an LED (light emitting diode) unit, which performs image formation, so that an image is formed on a sheet and a printing or copying operation is carried out.

The engine control unit 220A includes a CPU 300A, a RAM 221, a ROM 222, and an electric control unit 223. The CPU 300A includes a fixing control unit 350A. The fixing control unit 350A includes an image region detection unit 360, a heater selection unit 320A, and a heater drive unit 330. The image region detection unit 360 determines the image data received from the controller 210 as being a set of predetermined areas. Specifically, the image region detection unit 360 generates the data for each of the predetermined areas from the image data and determines the presence or absence of an image in each of the predetermined areas.

Figure 18:
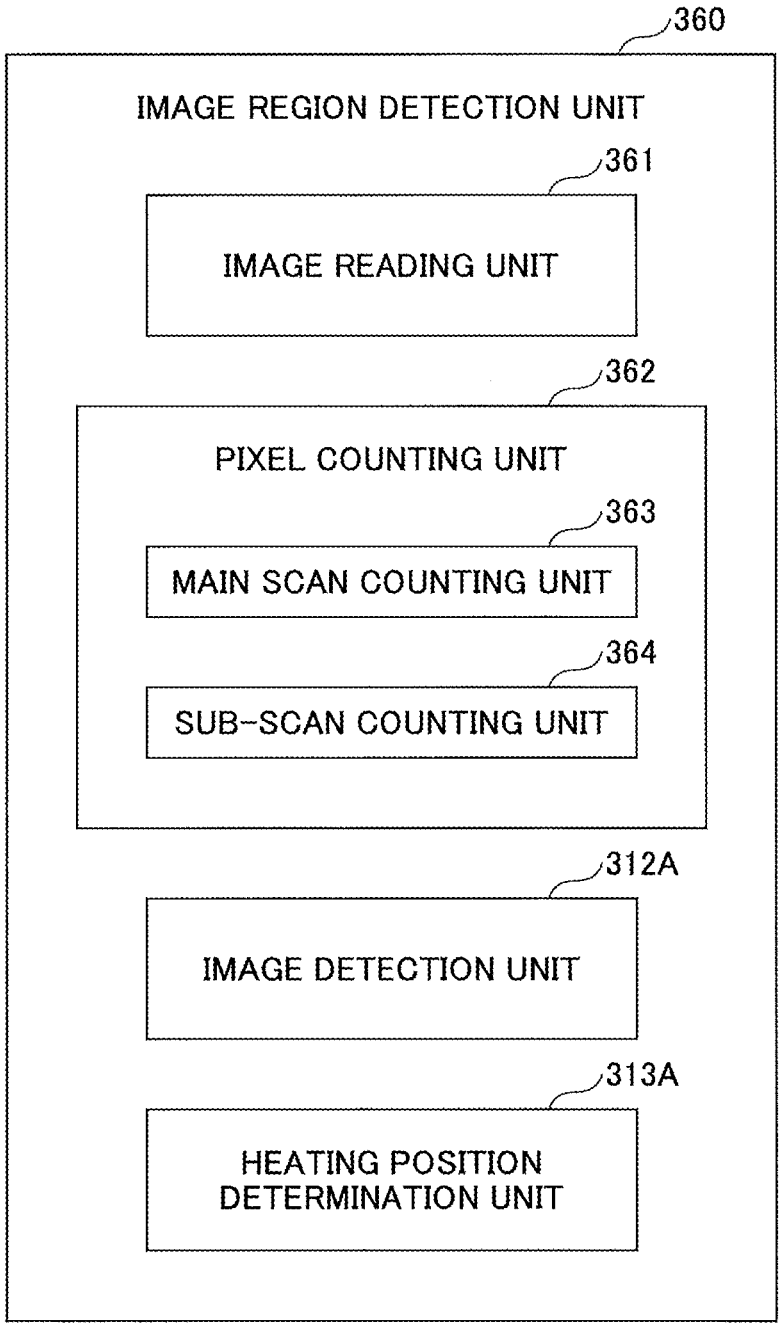
FIG. 18 is a diagram for explaining the functional composition of the image region detection unit according to the second embodiment.

Next, the image region detection unit 360 according to this embodiment is explained. FIG. 18 is a diagram for explaining the functional composition of the image region detection unit 360 according to the second embodiment.

The image region detection unit 360 includes an image reading unit 361, a pixel counting unit 362, an image detection unit 312A, and a heating position determination unit 313A.

The image reading unit 361 is configured to read the image data input from the controller 210. The read image data may be temporarily stored in the RAM 221 of the engine control unit 220A.

The pixel counting unit 362 is configured to count the pixels of the image data. The pixel counting unit 362 includes a main scan counting unit 363 and a sub-scan counting unit 364. The main scan counting unit 363 is configured to count the pixels of the image data in the main scanning direction. The sub-scan counting unit 364 is configured to count the pixels of the image data in the sub-scanning direction. The pixel counting unit 362 determines the image data as being a group of the predetermined areas. Namely, the pixel counting unit 362 performs the same processing as the pixel counting unit 243 according to the first embodiment except that the pixel counting unit 362 counts the pixels of the image data.

The main scan counting unit 363 counts the pixels of the image data in the main scanning direction. Specifically, the main scan counting unit 363 counts the widths of scan lines in the image data. The sub-scan counting unit 364 counts the pixels of the image data in the sub-scanning direction. Specifically, the sub-scan counting unit 364 counts the number of the scan lines in the image data.

Figure 19:
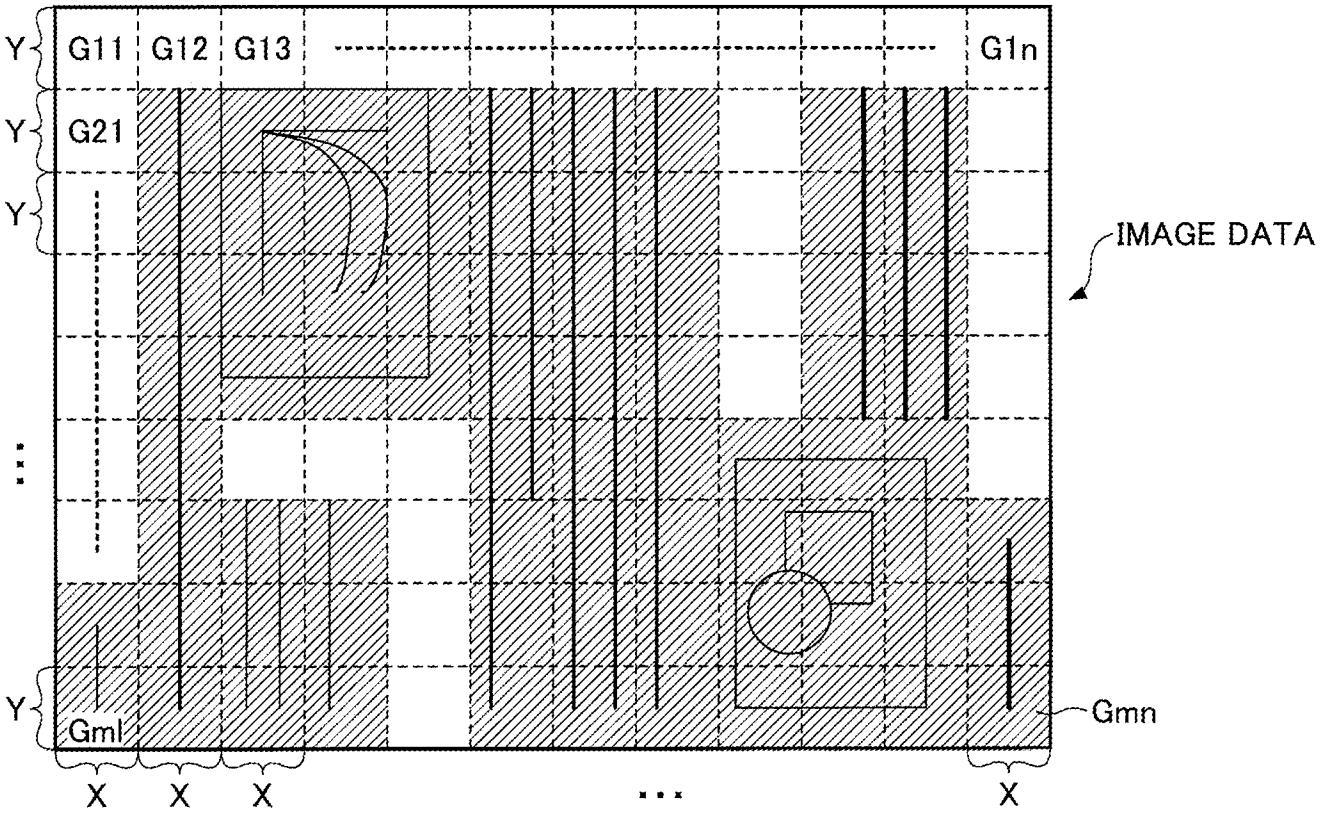
FIG. 19 is a diagram for explaining determination of areas in image data.

Next, the determination of areas according to this embodiment is explained. FIG. 19 is a diagram for explaining the determination of the areas in the image data.

Similar to the first embodiment, the pixel counting unit 362 determines the image data as being a matrix Emn of m×n elements in which each element is represented by a predetermined area G. It is assumed that the predetermined area G is the area of X×Y where X and Y denote length values in millimeters. In this embodiment, X=Y=2 millimeters.

The CPU 300A includes a plurality of registers corresponding to the plurality of the predetermined areas G, and the counted value by the pixel counting unit 362 is stored in one of the plurality of registers.

The pixel counting unit 362 performs the counting of pixels of the image data sequentially from the upper left position of the image data. The main scan counting unit 363 of the pixel counting unit 362 counts the pixels in the main scanning direction from the upper left position of the image data shown in FIG. 19, and stores the counted value of the pixels in the corresponding one of the registers for each area G.

While the main scan counting unit 363 performs the pixel counting of one line of the areas G11-G1n (equivalent to the length of X×n millimeters) in the main scanning direction, the sub-scan counting unit 364 performs the pixel counting of one line of the areas G11-Gm1 (equivalent to the length of Y×m millimeters) in the sub-scanning direction. In this case, the number of scan lines counted is equal to 1. At this time, the sum of the counted values of pixels in each of the areas G11-G1n in the main scanning direction is stored in one of the registers corresponding to the areas G11-G1n.

The pixel counting unit 362 performs the same processing for the area G21 and subsequent areas, and obtains the sum of the counted values of the pixels for each of the areas G11-Gmn.

Hence, the image region detection unit 360 obtains from the pixel counting unit 362 the sum of the pixel counted values for each of the areas of X×Y millimeters obtained by division of the image data. In this embodiment, the number of registers which is the same as the number of areas included in the image data may be provided. In this case, the number of registers is represented by the number of m×n. Alternatively, the number of registers which is the same as the number ("n") of areas included in the main scanning direction may be provided. In this case, when the counting of pixels in each of the areas G11-G1n is performed, the CPU 300 may temporarily store the values from the "n" registers in the RAM 221 and eliminate the values stored in all the "n" registers.

The image detection unit 312A performs the same processing as the first embodiment. Namely, the image detection unit 312A is configured to determine the presence or absence of the image in each of the plurality of the predetermined areas based on the value of the corresponding register in which the sum of the counted values of the area is stored by the pixel counting unit 362. Specifically, the image detection unit 312A determines the corresponding area as being the non-image region when the value of the register is equal to 0. The image detection unit 312A determines the corresponding area as being the image region when the value of the register is not equal to 0.

The heating position determination unit 313A performs the same processing as the first embodiment. Namely, the heating position determination unit 313A is configured to determine the image region as the heating position. After the heating position is determined, the heater selection unit 320 selects the heater 20*n* corresponding to the heating position so that the image region is heated by the selected heater 20*n*.

Figure 20:
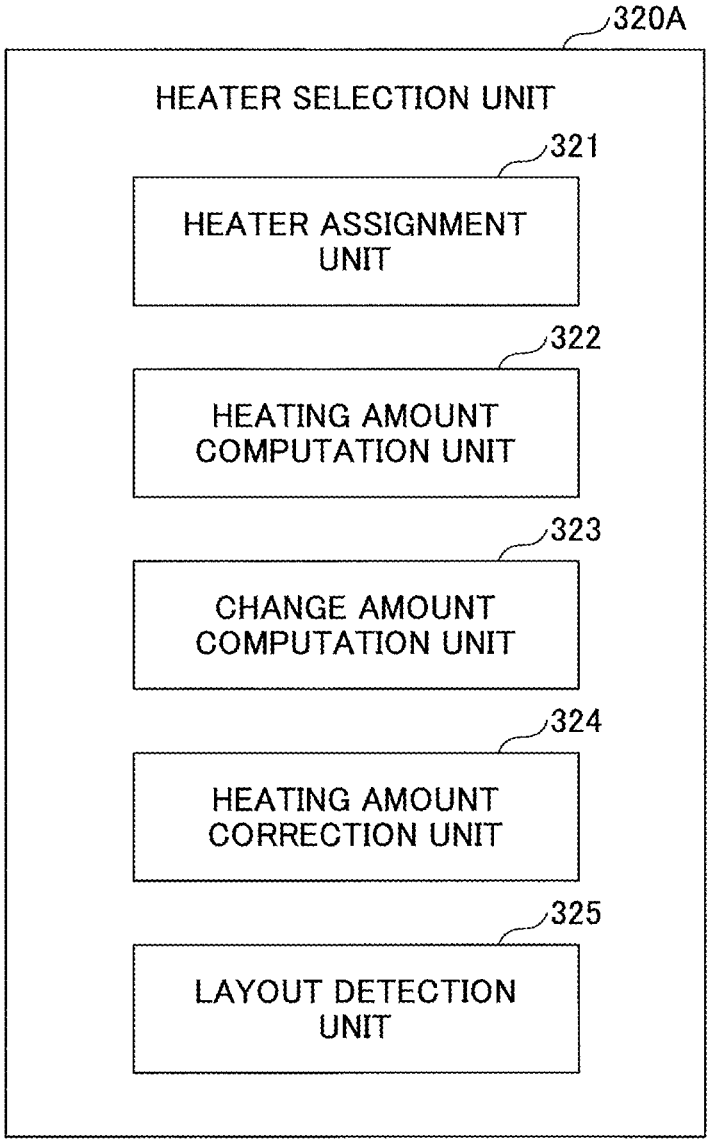
FIG. 20 is a diagram for explaining the functional composition of a heater selection unit according to the second embodiment.

Next, the heater selection unit 320A according to this embodiment is explained. FIG. 20 is a diagram for explaining the functional composition of the heater selection unit 320A according to the second embodiment.

The heater selection unit 320A includes a layout detection unit 325, in addition to the heater assignment unit 321, the heating amount computation unit 322, the change amount computation unit 323, and the heating amount correction unit 324.

The layout detection unit 325 is configured to determine where the recording material in which the image data is printed is disposed on the writing region 50. Namely, the layout detection unit 325 detects the position of the image data in the writing region 51.

The heater assignment unit 321 is configured to assign to the image region the heater 20*n* the heating area of which overlaps with the position of the image region in the image data after the position of the image data in the writing region 51 is detected by the layout detection unit 325.

Figure 21:
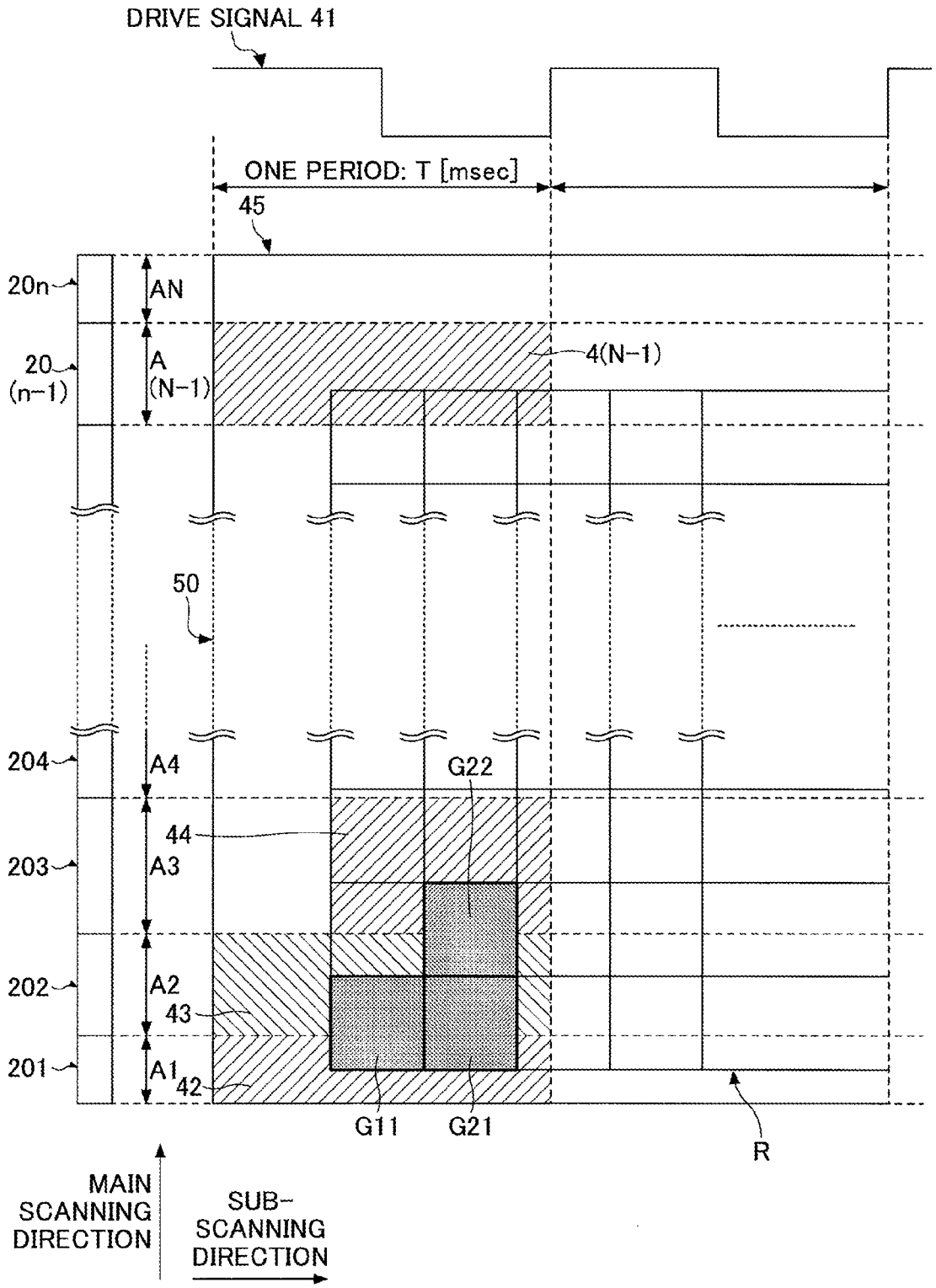
FIG. 21 is a diagram for explaining processing of a layout detection unit according to the second embodiment.

Next, processing of the layout detection unit 325 according to this embodiment is explained. FIG. 21 is a diagram for explaining processing by the layout detection unit 325 according to the second embodiment.

In FIG. 21, a conceptual diagram showing a state in which the image data which is divided into a plurality of areas Gmn is superimposed on a fixing region 45 is illustrated.

When a print request is received, the layout detection unit 325 determines positions of a front end, a rear end, a right end and a left end of a recording material R in a writing region 50, based on the layout information (length, width, etc.) of the recording material, the size of the recording material, and the transportation speed. Subsequently, the layout detection unit 325 detects the heating areas in the writing region 50 which overlap with the image region in which the image is fixed to the recording material.

In the example of FIG. 21, the left end of the front side of the recording material R overlaps the heating area 42 of the heater 201. Moreover, the right end of the front side of the recording material R overlaps the heating area 4(N−1) of the heater 20(*n*−1). Hence, in the example of FIG. 21, there is no part of the image region to which the heater 20*n* is assigned.

Moreover, in the example of FIG. 21, each of the areas G11, G21, and G22 based on the image data is part of the image region. The areas G11 and G21 are included in the heating area 42 of the heater 201, and the heating area 43 of the heater 202. Hence, the heater assignment unit 321 assigns the heaters 201 and 202 to the areas G11 and G21 each of which is part of the image region.

Moreover, in the example of FIG. 21, the area G22 is included in the heating area 43 of the heater 202 and the heating area 44 of the heater 203. Hence, the heater assignment unit 321 assigns the heaters 202 and 203 to the area G22 which is part of the image region.

The processing after the heater 20*n* is assigned to part of the image region is the same as that of the first embodiment, and a description thereof will be omitted.

As described above, the image data is divided into the plurality of areas, and the fixing control according to this embodiment uses only the data of the counted value of pixels for each of the plurality of areas. Hence, the data volume used in the fixing control may be reduced in comparison with the case of the fixing control using the writing control data based on the image data. Moreover, only the heaters to which the areas as parts of the image region are assigned are activated to heat the toner image to the fixing temperature. Hence, the electric power needed for the fixing may be reduced and the toner may be fixed efficiently.

Moreover, in this embodiment, the image data is determined as being a group of the predetermined areas and each area is assigned to the heaters. Therefore, the areas may be assigned to the heaters based on the heater information 22 stored in the ROM 222 even if the configuration and the number of the heaters change. Therefore, the fixing control device according to this embodiment is applicable regardless of the configuration and composition of the heaters, and flexibility may be increased.

Third Embodiment

Next, a description will be given of a third embodiment. In the third embodiment, the details of the correction of the heating amount for the heaters 201-20*n* as discussed in the first and second embodiments is explained.

In the following, the elements in the third embodiment which are the same as corresponding elements in the first and second embodiments are designated by the same reference numerals, and a description thereof will be omitted.

Figure 22:
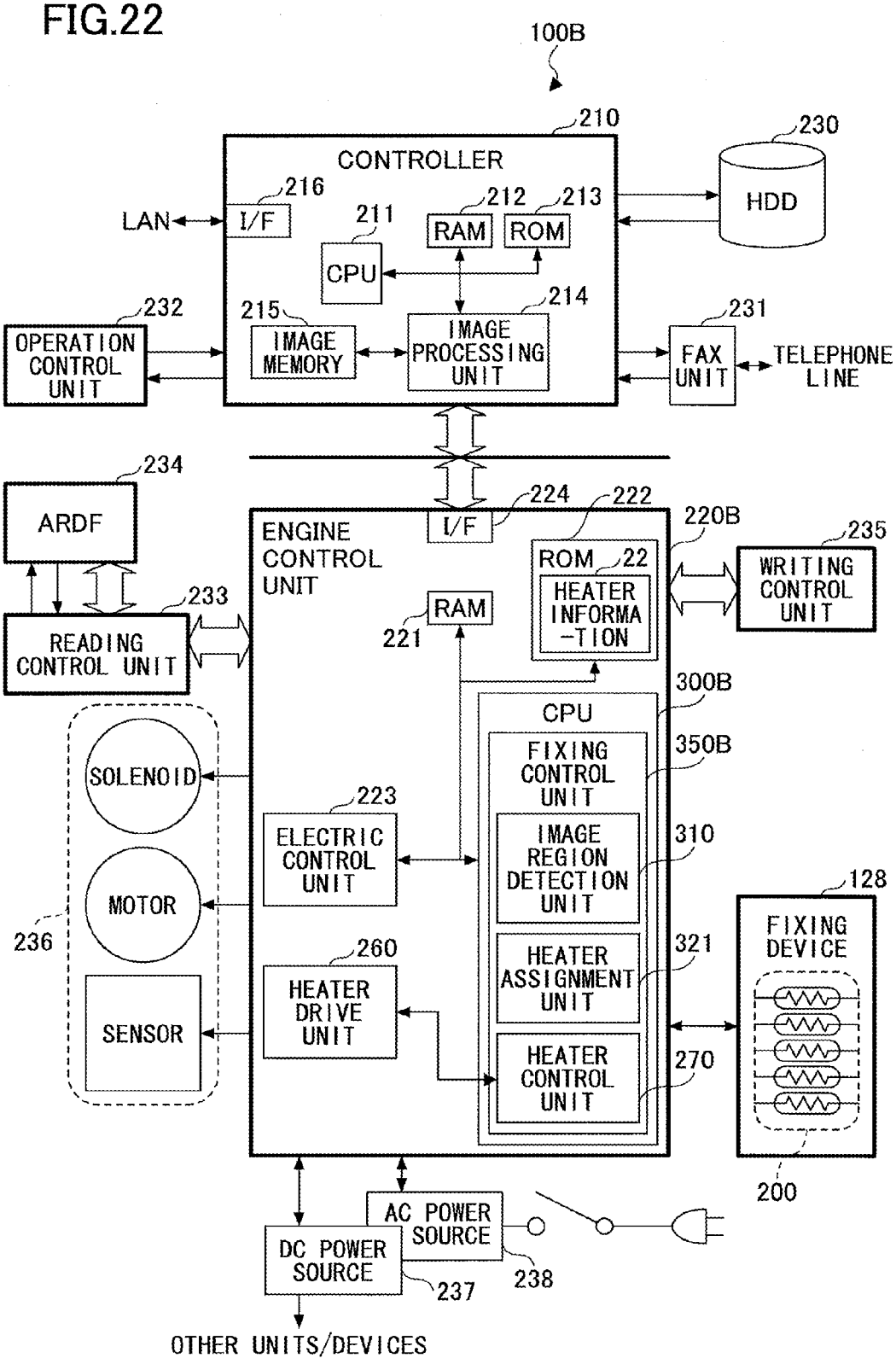
FIG. 22 is a diagram for explaining the composition of an image forming apparatus according to a third embodiment.

FIG. 22 shows the composition of an image forming apparatus 100B according to the third embodiment. The image forming apparatus 100B includes an engine control unit 220B. The engine control unit 220B includes a heater drive unit 260 and a CPU 300B.

The CPU 300B includes a fixing control unit 350B. The fixing control unit 350B includes an image region detection unit 310, a heater assignment unit 321, and a heater control unit 270.

The heater drive unit 260 supplies the electric power to drive the heater portion 200 to the heater portion 200. The heater control unit 270 controls the heating amount of the heater portion 200. In this embodiment, the operation of the heater drive unit 260 is controlled by the heater control unit 270.

The heater drive unit 260 is implemented by a power supply unit (PSU) which functions to control the power supply to the heater portion 200. When supplying electric power to the heater portion 200, the heater drive unit 260 performs a soft start so that the power supply to the heater portion 200 is increased moderately. When cutting off the power supply to the heater portion 200, the heater drive unit 260 performs a soft stop so that the power supply to the heater portion 200 is reduced moderately. In this embodiment, the heating amount in the heaters 201-20*n* is corrected by performing a soft start to increase the heating amount of each of the heaters 20*n* moderately, and a soft stop to reduce the heating amount of each of the heaters 20*n* moderately.

Specifically, the heater drive unit 260 of this embodiment performs the soft start and the soft stop when the amount of change of the heating amount of the heater 20*n* in the heating area is greater than or equal to the predetermined threshold.

In the following, the heating amount of the heater 20*n* corresponds to and is synonymous with the energy supplied to the heater 20*n*.

Figure 23:
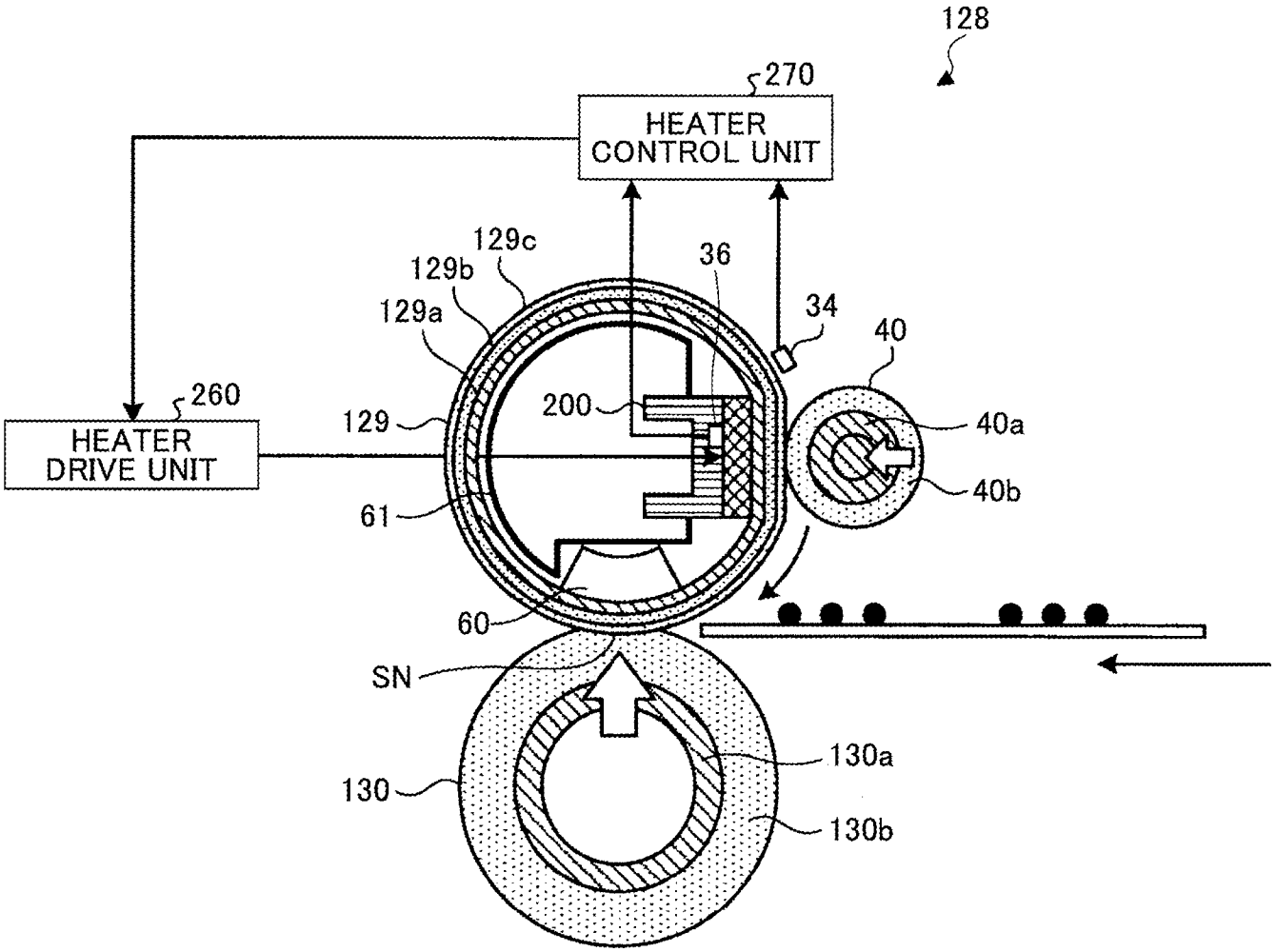
FIG. 23 is a cross-sectional view of a fixing device according to the third embodiment.

Next, the relationship between the heater drive unit 260, the heater control unit 270 and the fixing device 128 is explained. FIG. 23 is a cross-sectional view of the fixing device 128 according to the third embodiment.

As shown in FIG. 23, the fixing device 128 includes a fixing roller 129 and a pressure roller 130. The fixing roller 129 and the pressure roller 130 are held to each other by a force applied to the pressure roller 130 and form a nip portion SN. The fixing roller 129 and the pressure roller 130 are rotated by a drive device (which is not illustrated) and transport a sheet sandwiched between the rollers 129 and 130 at the fixing nip portion SN.

The fixing roller 129 functions as a transporting member. The fixing roller 129 includes a substrate 129*a* and an elastic layer 129*b*. For example, the substrate 129*a* is made of a stainless steel (SUS) and has an outside diameter of 40 mm and a thickness of 40 μm. The surface of the substrate 129*a* is coated with the elastic layer 129*b*. For example, the elastic layer 129*b* is formed of a silicone rubber and has a thickness of 100 μm. In order to improve durability and secure releasing characteristics, the outermost surface of the fixing roller 129 is coated with a releasing layer 129*c*. For example, the releasing layer 129*c* is made of PFA (tetrafluoroethylene-perfluoroalkoxyethylene copolymer) or PTFE (polytetrafluoroethylene), and has a thickness in a range of 5-50 μm. Alternatively, the substrate 129*a* of the fixing roller 129 may be made of polyimide. In the inside of the fixing roller 129, a belt support member 61 is arranged and a nip formation member 60 is disposed at the position of the nip portion SN. The belt support member 61 and the nip formation member 60 of the fixing roller 129 are connected to an external member (side plate) (which is not illustrated) so that the fixing roller 129 is supported.

The pressure roller 130 includes a core metal 130*a* and an elastic layer 130*b*. For example, the core metal 130*a* is made of iron and has an outside diameter of 40 mm and a thickness of 2 mm. The outside surface of the core metal 130*a* is coated with the elastic layer 130*b*. For example, the elastic layer 130*b* is formed of a silicone rubber, and has a thickness of 5 mm. Further, it is desirable that a fluororesin layer be formed on the surface of the elastic layer 130*b* with a thickness of about 40 μm, in order to improve releasing characteristics. The pressure roller 130 is pressed on the fixing roller 129 by a pressing device (which is not illustrated).

Moreover, in the inside of the fixing roller 129, the heater portion 200 as a power load is arranged. The heater drive unit 260 controlled by the heater control unit 270 is connected to the heater portion 200.

Moreover, the pressing roller 40 is disposed at the position which faces the heater portion 200 of the fixing roller 129, for keeping a good contact state of the fixing roller 129 and the heater portion 200. The pressing roller 40 is pressed on the fixing roller 129 by a pressing device (which is not illustrated). The pressing roller 40 may be implemented by a pad or a brush which is appropriate for keeping the contact state of the fixing roller 129 and the heater portion 200. The pressing roller 40 includes a core metal 40*a* and an elastic layer 40*b*. The surface of the core metal 40*a* is coated with the elastic layer 40*b*. For example, the core metal 40*a* is made of iron and has an outside diameter in a range of 15-30 mm and an inside diameter of 8 mm. For example, the elastic layer 40*b* is formed of a silicone rubber and has a thickness in a range of 3.5-11 mm. It is desirable to form a fluororesin layer on the surface of the elastic layer 40*b* with a thickness of about 40 μm, in order to improve releasing characteristics.

Moreover, a thermistor 34 is disposed on the outer peripheral surface of the fixing roller 129 to contact the fixing roller 129, and the thermistor 34 functions as a temperature detection unit that detects a surface temperature of the fixing roller 129. In addition, a thermistor 36 is disposed on the heater portion 200 and the thermistor 36 functions as a temperature detection unit that detects a temperature of the heater portion 200.

The heater control unit 270 is configured to control the heater drive unit 260 based on the detection information from the thermistor 34 and the thermistor 36.

Figure 24:
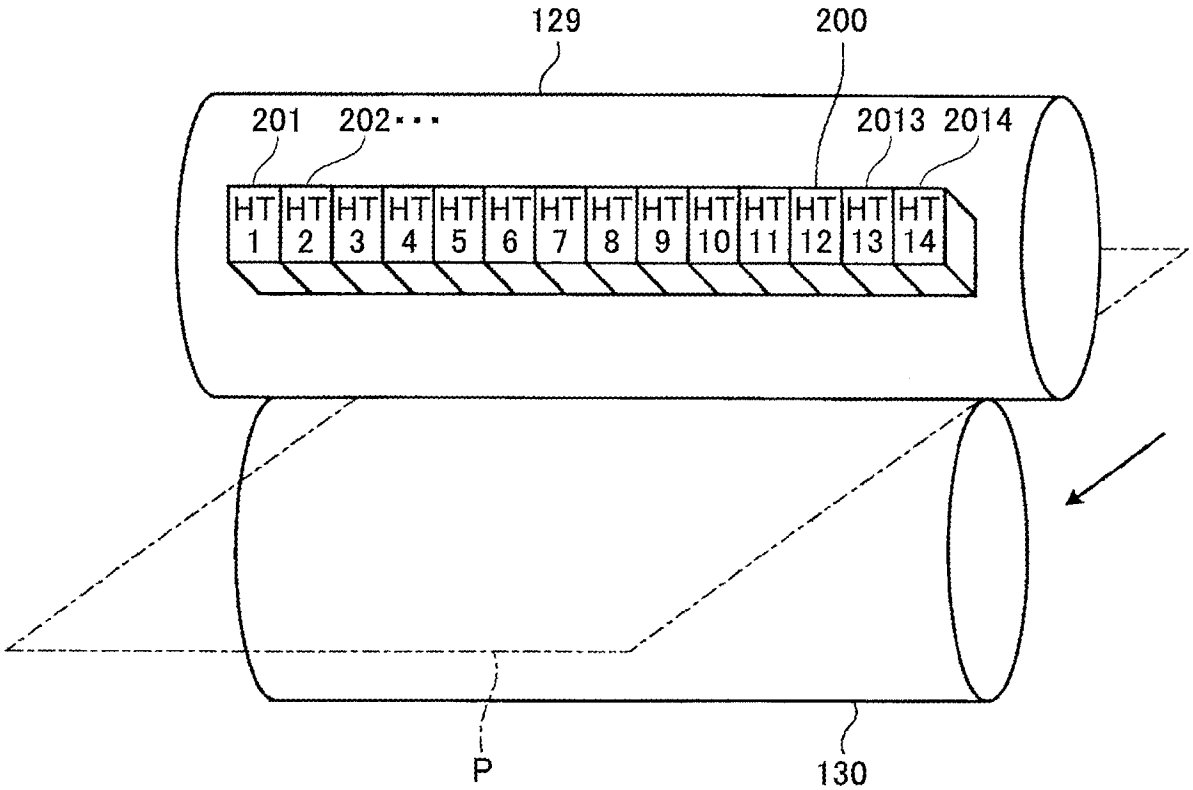
FIG. 24 is a diagram showing the composition of heaters according to the third embodiment.

FIG. 24 shows the composition of the heaters according to the third embodiment. The heater portion 200 provided in the fixing roller 129 includes a heating region which is heated by a plurality of heaters 20*n*. The plurality of heaters 20*n* are arrayed in a line parallel to a width direction of a sheet P (which direction is perpendicular to a sheet transport direction) as shown in FIG. 24. In the example of FIG. 24, fourteen heaters 201, 202, . . . , 2014 are arrayed within the heating region in a line parallel to the sheet width direction. These heaters 201-2014 in the fixing roller 129 may be activated by the heater drive unit 260 independently of each other.

Figure 25:
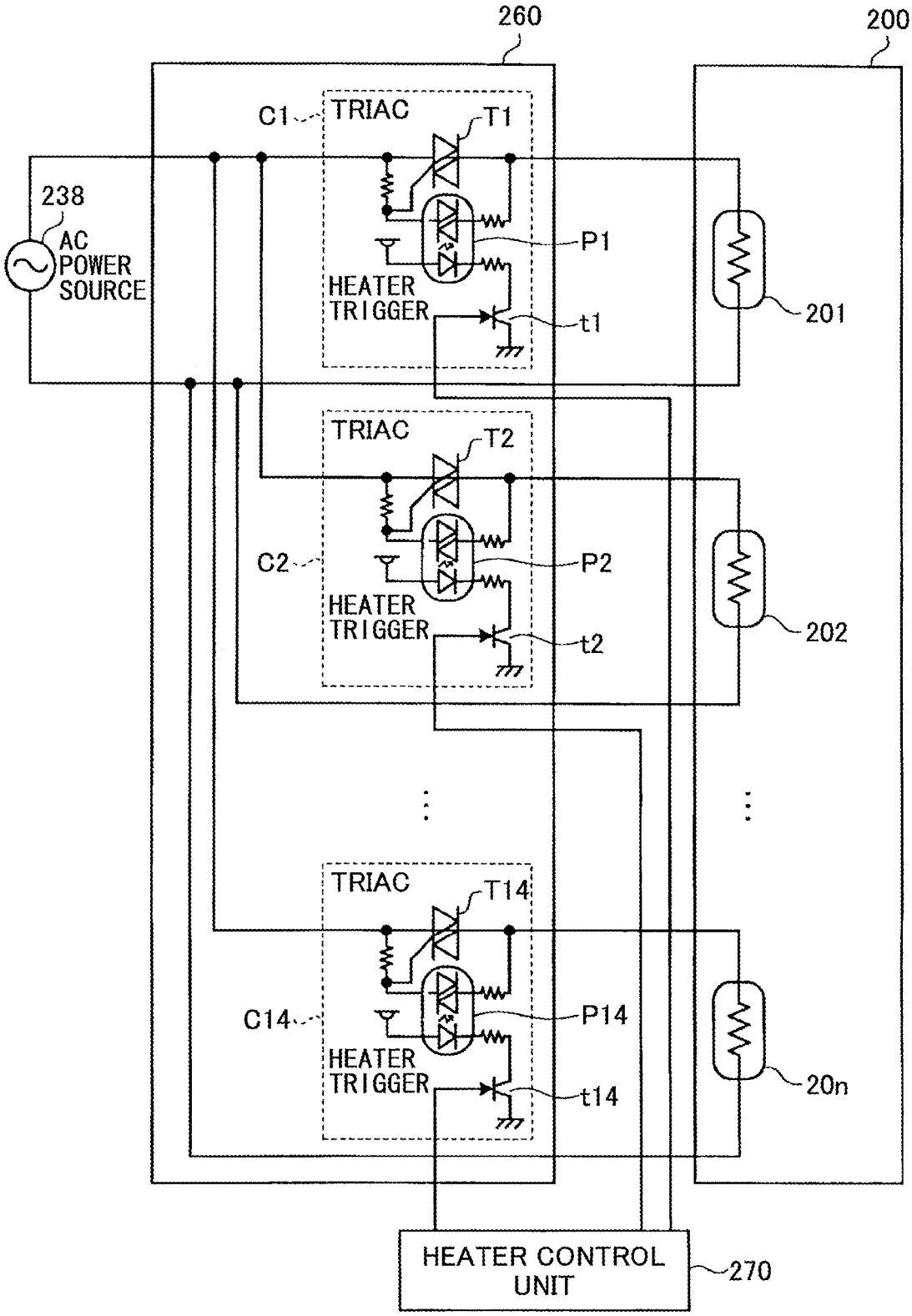
FIG. 25 is a diagram for explaining an example of a heater drive unit according to the third embodiment.

Next, the heater drive unit 260 according to this embodiment is explained. FIG. 25 shows an example of the heater drive unit 260 according to the third embodiment.

AC power from the AC power source 238 is supplied to the heater drive unit 260. The heater drive unit 260 includes a plurality of drive circuits C1-C14 which are provided for turning ON and OFF the heaters 201-2014 (HT1-HT14) which are included in the heater portion 200 of the fixing device 128. The drive circuits C1-C14 are connected to the heaters 201-2014 through photo couplers P1-P14, temperature control TRIACs T1-T14 and transistors t1-t14, respectively. The TRIACs T1-T14 are provided to control the power supply to the heaters 201-2014 for temperature control. Each of the photo couplers P1-P14 functions as a heater trigger that initiates a start or a stop of the power supply to the heater in one of the TRIACs T1-T14.

Each of the temperature control TRIACs T1-T14 is a load control unit in which turning ON or OFF of the corresponding load is selectively controllable. Each of the temperature control TRIACs T1-T14 is implemented by an element by which two thyristors in reverse positions are connected in parallel. The photo couplers P1-P14 are of non-zero crossing switching type. By using the photo couplers P1-P14, the power supply to the heaters 201-2014 is controlled by an arbitrary phase angle of the AC power source 238. The phase angle of the AC power source 238 is determined by a heater trigger signal received from the heater control unit 270.

The heater control unit 270 outputs the heater trigger signal on the basis of a zero crossing signal output from a zero crossing detector (not shown) which detects a zero crossing point of the power voltage supplied from the AC power source 238.

Each of the temperature control TRIACs T1-T14 is turned ON when the heater trigger signal output from the heater control unit 270 via one of the transistors t1-t14 is set in an ON state and one of the photo couplers P1-P14 is switched ON to supply a voltage exceeding a reference voltage to the gate terminal of the transistor. Thereby, the power from the AC power source 238 is supplied to the corresponding one of the heaters 201-2014 and the corresponding heater is turned ON (activated). On the other hand, each of the temperature control TRIACs T1-T14 is turned OFF when the heater trigger signal output from the heater control unit 270 via one of the transistors t1-t14 is set in an OFF state and one of the photo couplers P1-P14 is switched OFF to set the voltage of the gate terminal to be less than the reference voltage. Thereby, the supply of the power from the AC power source 238 to the heaters 201-2014 is cut off.

Figure 26:
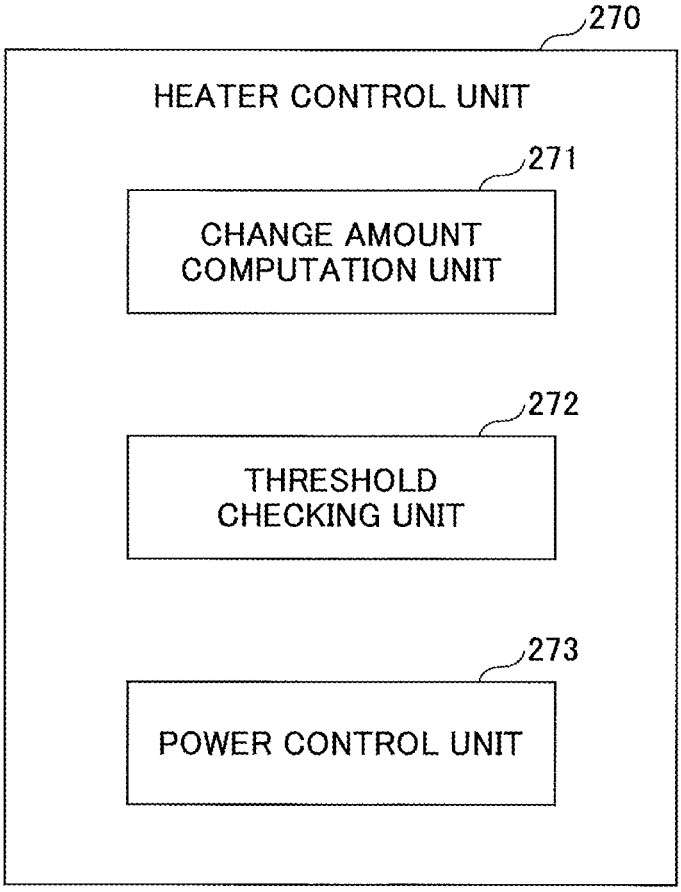
FIG. 26 is a diagram for explaining the functional composition of a heater control unit according to the third embodiment.

Next, the heater control unit 270 according to this embodiment is explained. FIG. 26 shows the functional composition of the heater control unit 270 according to the third embodiment.

As shown in FIG. 26, the heater control unit 270 includes a change amount computation unit 271, a threshold checking unit 272, and a power control unit 273.

The change amount computation unit 271 is configured to compute an amount of change of the power supply to the heaters 201-2014 for a predetermined time based on the image region or the non-image region in the main scanning direction which is perpendicular to the sheet transport direction (the sub-scanning direction).

The threshold checking unit 272 is configured to determine whether the amount of change of the power supply computed by the change amount computation unit 271 is greater than or equal to a predetermined threshold.

The power control unit 273 is configured to perform, when the amount of change of the power supply is determined as being greater than or equal to the threshold by the threshold checking unit 272, a soft start to increase the power supply moderately at the time of turning ON one of the heaters 201-2014 corresponding to the image region, and a soft stop to reduce the power supply moderately at the time of turning OFF one of the heaters 201-2014 corresponding to the image region by controlling the heater drive unit 260.

Figure 27A:
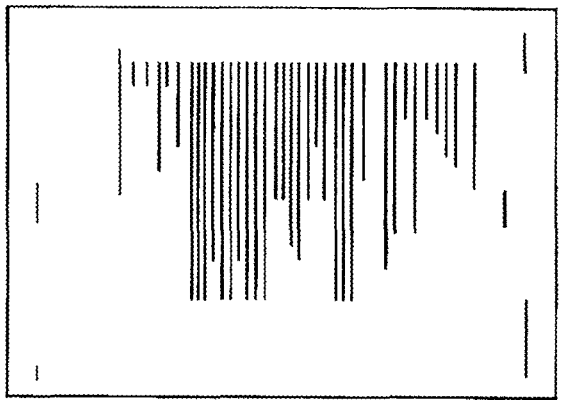
FIG. 27A, FIG. 27B, and FIG. 27C are diagrams showing an example of heating according to an image.
Figure 27B:
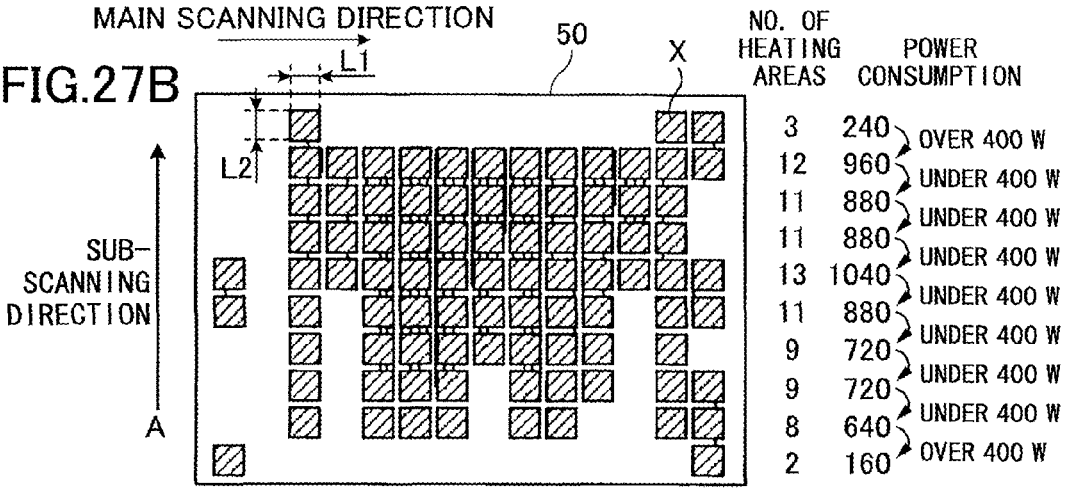
Figure 27C:
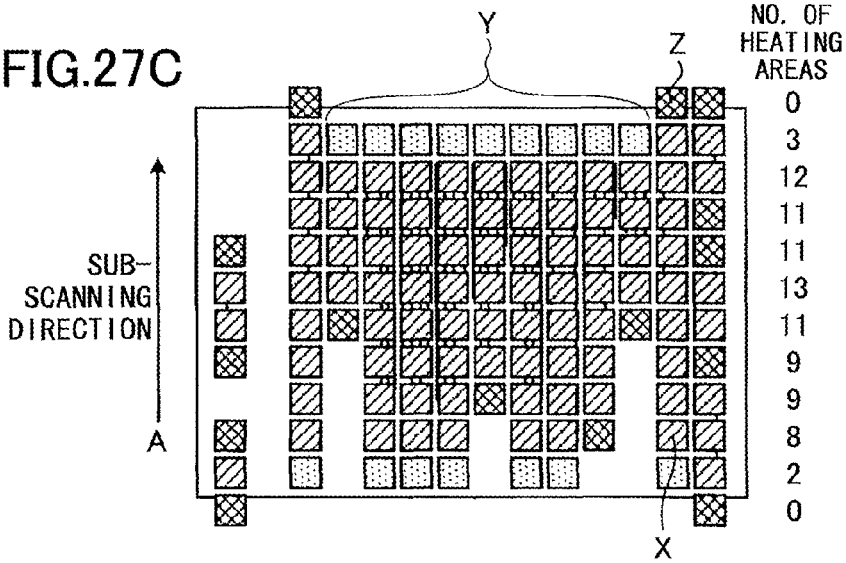

Next, the power control processing of the image forming apparatus 100B is explained. FIG. 27A, FIG. 27B, and FIG. 27C are diagrams showing an example of heating according to an image.

FIG. 27A shows an example in which image data is transferred to a sheet in which the image region and the non-image region coexist on the downstream side of the sheet transport direction (the sub-scanning direction) in the longitudinal direction (the main scanning direction) of the heater portion 200 perpendicular to the sheet transport direction.

The heater control unit 270 turns ON the heaters 201-2014 corresponding to the position where toner is placed in order to fix the toner to the sheet.

In this embodiment, the heaters 20*n* corresponding to the image region are assigned to the image region by the image region detection unit 310 and the heater assignment unit 321, and the heater control unit 270 detects in advance which of the heaters 201-2014 are to be turned ON.

The rectangular blocks in FIG. 27B indicate the heating areas in which the heaters 20*n* assigned to the image region are to be turned ON. A length L1 of each heating area in the main scanning direction is determined by the width of the heaters 20*n*, and a length L2 of each heating area in the sheet transport direction (the sub-scanning direction) is determined by the movement distance of the heaters 20*n* proportional to the rotational speed of the fixing roller 129.

In the heater control unit 270, the change amount computation unit 271 performs detection of the number of heating areas and analysis of the power consumption.

If the temperature control is performed to reduce the power consumption, there may be a case in which the temperature of the heaters 20*n* is not raised to the highest temperature. However, for the sake of convenience of description, it is assumed that the temperature of the heaters 20*n* in the heating area is raised to the highest temperature (a full lighting state). In the following, it is assumed that when one of the heaters 20*n* is in the full lighting state, the power consumption is equal to 80 W.

In the example of FIG. 27B, the area (the image region) in which the temperature of the heaters 20*n* is raised to the highest temperature by controlling the heaters 201-2014 with respect to the image shown in FIG. 27A is indicated by the shading "X". In the example of FIG. 27B, the number of the turned-ON heaters 20*n* in a line across which is perpendicular to the sub-scanning direction and the power consumption are illustrated.

When analyzing the number and the power consumption of the turned-ON heaters, the threshold checking unit 272 determines whether the power fluctuation for a predetermined period is greater than or equal to a threshold. The threshold of the power fluctuation at which the occurrence of flicker is determined is set to 400 W. In the example of FIG. 27B, it is indicated that the power fluctuation for the image of FIG. 27A is under 400 W or over 400 W.

The power control unit 273 does not perform the soft start and the soft stop for the lines in which the power fluctuation is determined as being under 400 W. On the other hand, the power control unit 273 performs the soft start and the soft stop by controlling the heater drive unit 260 for the lines in which the power fluctuation is determined as being over 400 W.

In the example of FIG. 27C, the shading X indicates the areas (the image region) in which of the heaters 20*n* are raised to the highest temperature by controlling the heaters with respect to the image shown in FIG. 27A, and the textured pattern Y indicates the areas in which the soft start and the soft stop are performed. The shading Z indicates the areas in which the soft start and the soft stop are not performed because the power fluctuation is determined as being under 400 W.

In this embodiment, the soft start and the soft stop are not performed when the power fluctuation is under 400 W, and the soft start and the soft stop are performed when the power fluctuation is over 400 W. Hence, the power consumption may be reduced and the occurrence of flicker may be prevented.

Next, the effect of this embodiment is explained with reference to FIG. 28A and FIG. 28B. In this embodiment, only when the amount of change of the power consumption is over the threshold, the soft start and the soft stop are performed, and the power consumption may be reduced and the occurrence of flicker may be prevented.

Figure 28A:
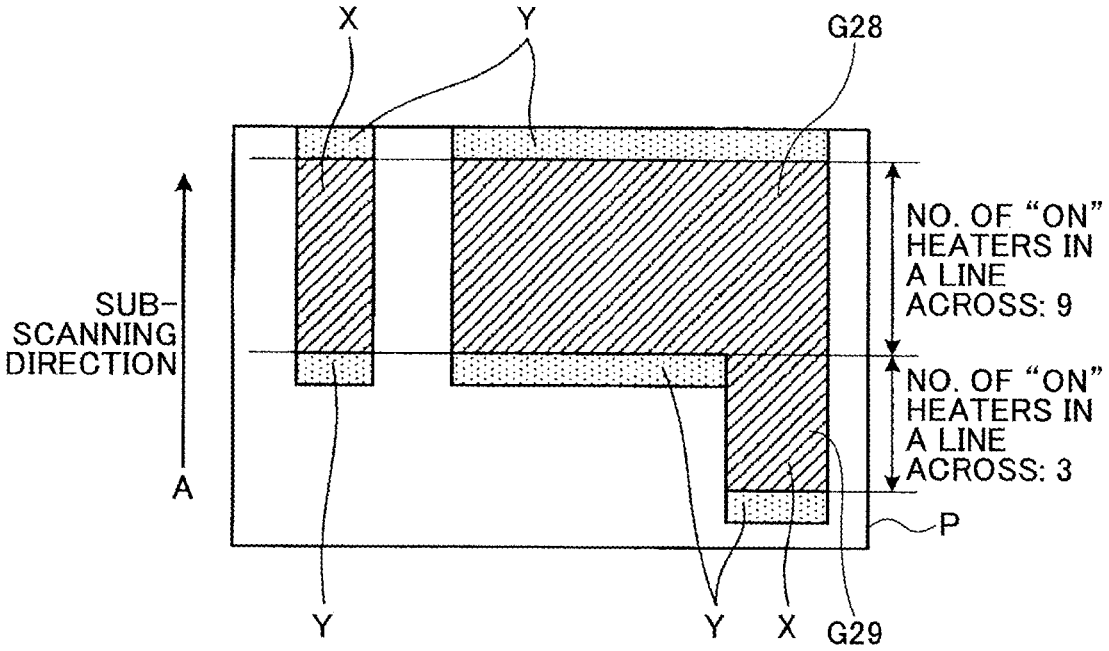
FIG. 28A and FIG. 28B are diagrams for explaining the effect of the third embodiment.
Figure 28B:
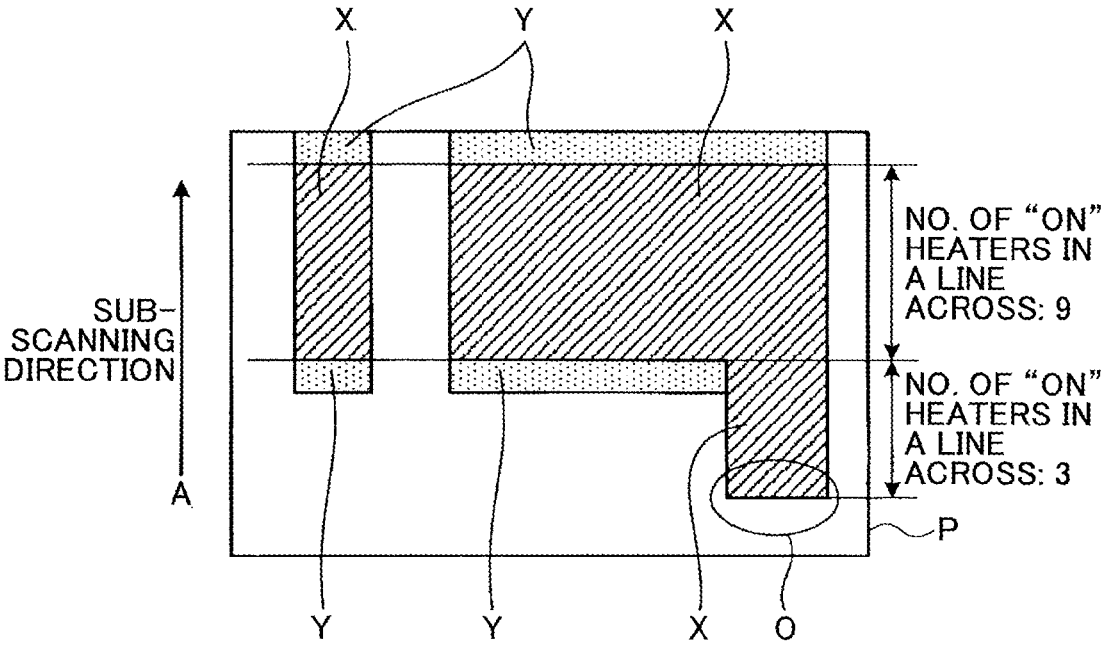

FIG. 28A and FIG. 28B are diagrams for explaining the effect of the third embodiment. FIG. 28A shows an example of heating in which the soft start and the soft stop are performed before and after an image region X is present. FIG. 28B shows an example of heating to which the third embodiment is applied.

In the example of FIG. 28A, there is no need to turn ON the heaters 201-2014 (14 heaters×80 W) and only the heaters corresponding to the image region X are turned ON. Hence, the nine heaters in a line in the main scanning direction at the maximum are turned ON, and the power consumption is reduced to 720 W (=9×80 W).

In the example of FIG. 28A, there is a transition line where the number of the turned-ON heaters 20*n* changes from nine to three. In this example, the soft start and the soft stop are performed before and after the image region X is present, and the soft start is performed on the nine heaters 20*n* before the nine heaters 20*n* are turned ON. Moreover, on the transition line where the number of the turned-ON heater 20*n* changes from nine to three, the soft stop is performed on the six heaters 20*n* from among the nine heaters 20*n*.

Moreover, in the example of FIG. 28A, there is a transition line where the number of the turned-ON heaters 20*n* changes from three to zero. On this transition line, the soft stop is performed on the three heaters 20*n*. In this case, there is the area (indicated by the textured pattern Y) where the number of the turned-ON heaters 20*n* changes to zero but the soft start or the soft stop is performed. Namely, the soft start or the soft stop is performed in the non-image region, and the power which is not used for the fixing is consumed.

On the other hand, in the example of FIG. 28B, the amount of change of the power consumption when the number of the turned-ON heaters 20*n* changes from three to zero is less than the threshold, and therefore the soft stop is not performed in the area indicated by "O" in FIG. 28B. Hence, in the example of FIG. 28B, the power consumption may be reduced from that in the example of FIG. 28A.

In this embodiment, the power consumption when one of the heaters 20*n* is in the full lighting state is equal to 80 W. The power consumption may vary according to the temperature control. When reducing the power consumption by the temperature control, the threshold checking unit 272 may determine whether the soft start and the soft stop are to be performed based on the power consumption which is reduced by the temperature control.

Moreover, in this embodiment, the power consumption is used as the amount of change of the power supply to the heaters 201-2014. Alternatively, instead of the power consumption, the number of the turned-ON heaters among the heaters of the heater portion 200 may be used as the amount of change of the power supply. In this case, the threshold for determining whether the soft start and the soft stop are to be performed may be a threshold of the number of the turned-ON heaters 20*n* (in this case, the threshold is equal to five (400 W=5×80 W). In this case, the performance of the soft start and the soft stop may be determined by the number of heating areas without computing the power consumption. Hence, the control is performed by the software of simple composition, and the power consumption may be reduced and the occurrence of flicker may be prevented.

The value of the threshold (=400 W) in this embodiment is obtained by experiments or experience. The value of the threshold may vary depending on the devices.

Moreover, the heating areas in this embodiment may be the areas heated by the heaters 20*n* assigned to the areas Emn which are determined as being the image region based on the light-on control signal as in the first embodiment. Alternatively, the heating areas in this embodiment may be the areas heated by the heaters 20*n* assigned to the areas Emn which are determined as being the image region based on the image data as indicated in the second embodiment.

Fourth Embodiment

Next, a description will be given of a fourth embodiment. The elements in the fourth embodiment which are the same as corresponding elements in the third embodiment are designated by the same reference numerals, and a description thereof will be omitted.

Figure 29:
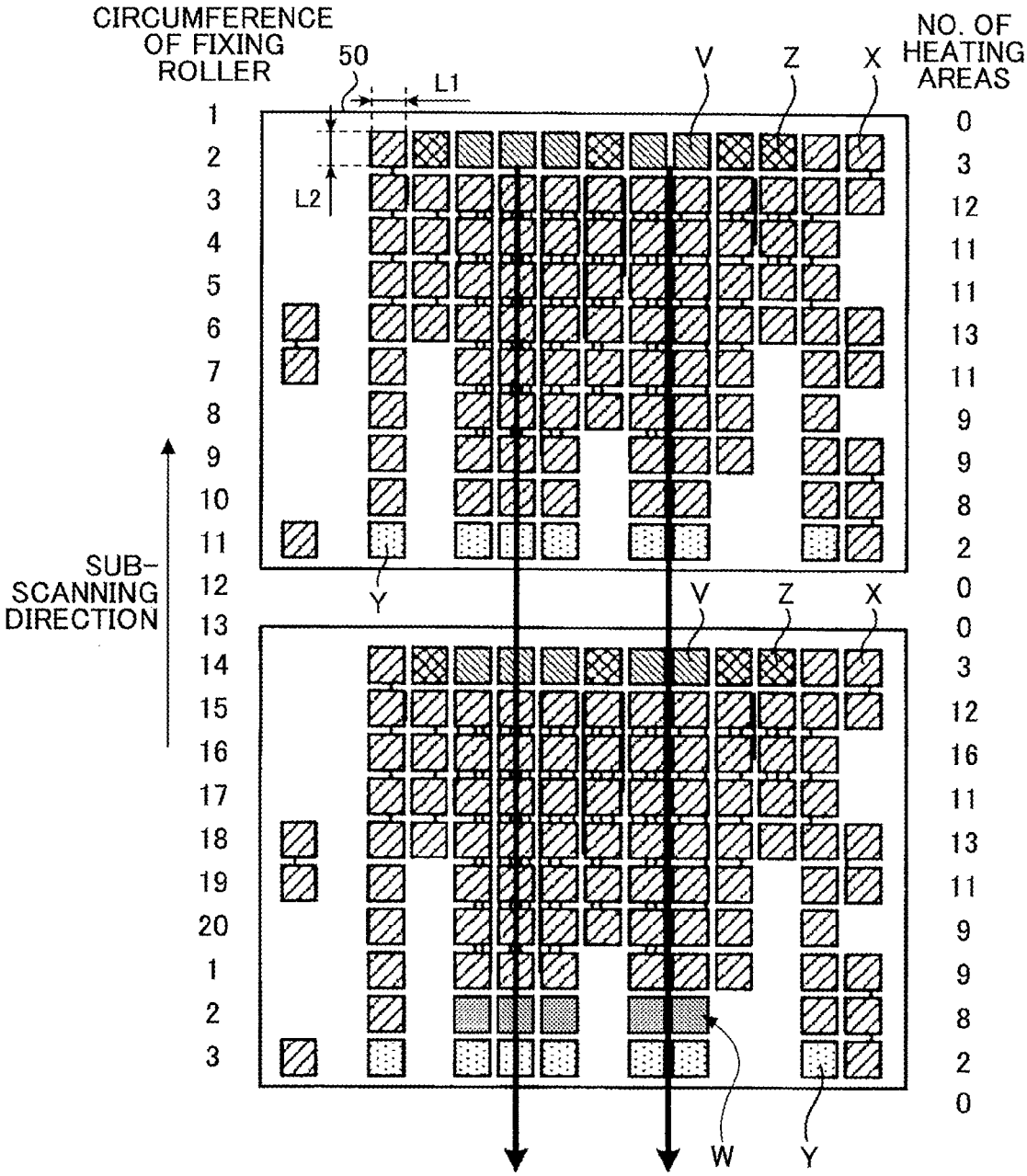
FIG. 29 is a diagram showing an example of heating according to image data according to a fourth embodiment.

FIG. 29 shows an example of heating based on the image data according to the fourth embodiment. In FIG. 29, a case in which two or more copies of the original image shown in FIG. 27A are printed is assumed. A fixed image of a first copy is illustrated on the downstream side in the sub-scanning direction (sheet transport direction) in FIG. 29, and a fixed image of a second copy is illustrated on the upstream side in the sub-scanning direction (sheet transport direction) in FIG. 29.

Moreover, in the example of FIG. 29, a length value which is obtained by dividing the length of the outer circumference of the fixing roller 129 by 20 is set to a length L2 of the heating area in the sub-scanning direction. In FIG. 29, the numerical values "1", "2", and "3" of the second turn, indicate the state after the fixing roller 129 is rotated by one revolution.

Similar to the third embodiment, the soft start and the soft stop are not performed when the power fluctuation is under 400 W, and the soft start and the soft stop are performed when the power fluctuation is over 400 W. Hence, in this embodiment, the power consumption may be reduced and the occurrence of flicker may be prevented.

In this embodiment, the power control unit 273 is configured to perform the soft start and the soft stop on the heating areas in which some of the heaters 201-2014 are activated after the fixing roller 129 is rotated by one revolution, by monitoring the rotation of the fixing roller 129.

In the example of FIG. 29, the area indicated by the shading V becomes the area (indicated by the shading W) in which the temperature of the heaters 201-2014 is raised by controlling the heaters 201-2014 after the fixing roller 129 is rotated by one revolution. Namely, the area indicated by the shading W needs to be heated to the fixing temperature H3 after the fixing roller 129 is rotated by one revolution. Hence, in this embodiment, by preheating the area indicated by the shading V, the amount of the power supply at the following revolution of the fixing device 129 is reduced, and the power consumption may be reduced.

The amount of the power supply to the heaters corresponding to the areas indicated by the shading V when the preheating is performed may be determined by averaging the minimum amount of the power supply by the number of the heaters 201-2014 on which the preheating is performed. In the example of FIG. 27C according to the third embodiment, the power supply to the heaters corresponding to the areas indicated by the textured pattern Y is equal to 360 W (=9×40 W). Hence, the minimum amount of the power supply needed for the example may be 360 W. In the example of FIG. 29, the number of the heaters 201-2014 on which the preheating is performed is set to five as indicated by the shading V in FIG. 29. Hence, in the example of FIG. 29, the amount of the power supply to the heaters corresponding to the areas indicated by the shading V for the preheating is set to 72 W (=360 W/5).

It is necessary to change the power supply to the heaters 20*n* to heat the areas indicated by the shading V. Changing the power supply to the heaters 20*n* may be performed by increasing the time of the drive signal 41 supplied to the heaters 20*n* which is set in an H level.

As shown in FIG. 29, the position corresponding to the heater 2013 corresponds to the position of the non-image region in the sub-scanning direction. Turning ON the heater at the position corresponding to the non-image region is not needed. Hence, because the soft start and the soft stop are not performed on the heater 2013, the power consumption may be reduced.

Fifth Embodiment

Next, a description will be given of a fifth embodiment. The elements in the fifth embodiment which are the same as corresponding elements in the third or fourth embodiment are designated by the same reference numerals, and a description thereof will be omitted.

Figure 30:
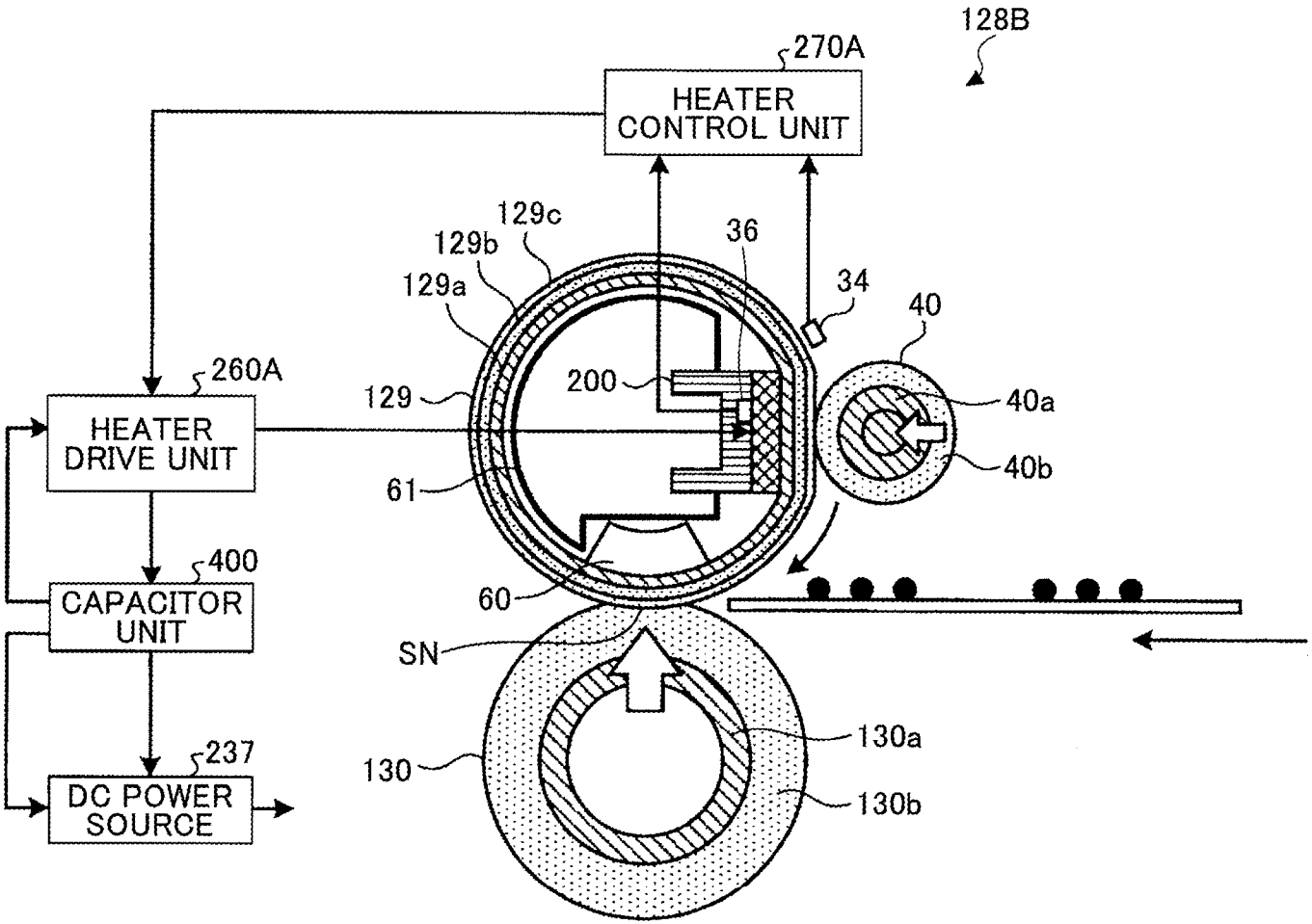
FIG. 30 is a cross-sectional view of a fixing device according to a fifth embodiment.

FIG. 30 is a cross-sectional view of a fixing device 128B according to the fifth embodiment. The fixing device 128A according to this embodiment differs from the third embodiment or the fourth embodiment in that the electric power output from the heater drive unit 260A may be stored as electric energy in a capacitor unit 400, such as a capacitor.

Although not illustrated, the heater drive unit 260A receives the electric power from the commercial power source and electric power from the capacitor unit 400.

The heater control unit 270A is configured to perform control so that the electric power, received from the commercial power source and the capacitor unit 400 at the heater drive unit 260A, is supplied to the heater portion 200.

The capacitor unit 400 is configured to output the stored electric energy also to the DC power source 237. The DC power received at the DC power source 237 is supplied to devices and components other than the fixing device 128.

Figure 31:
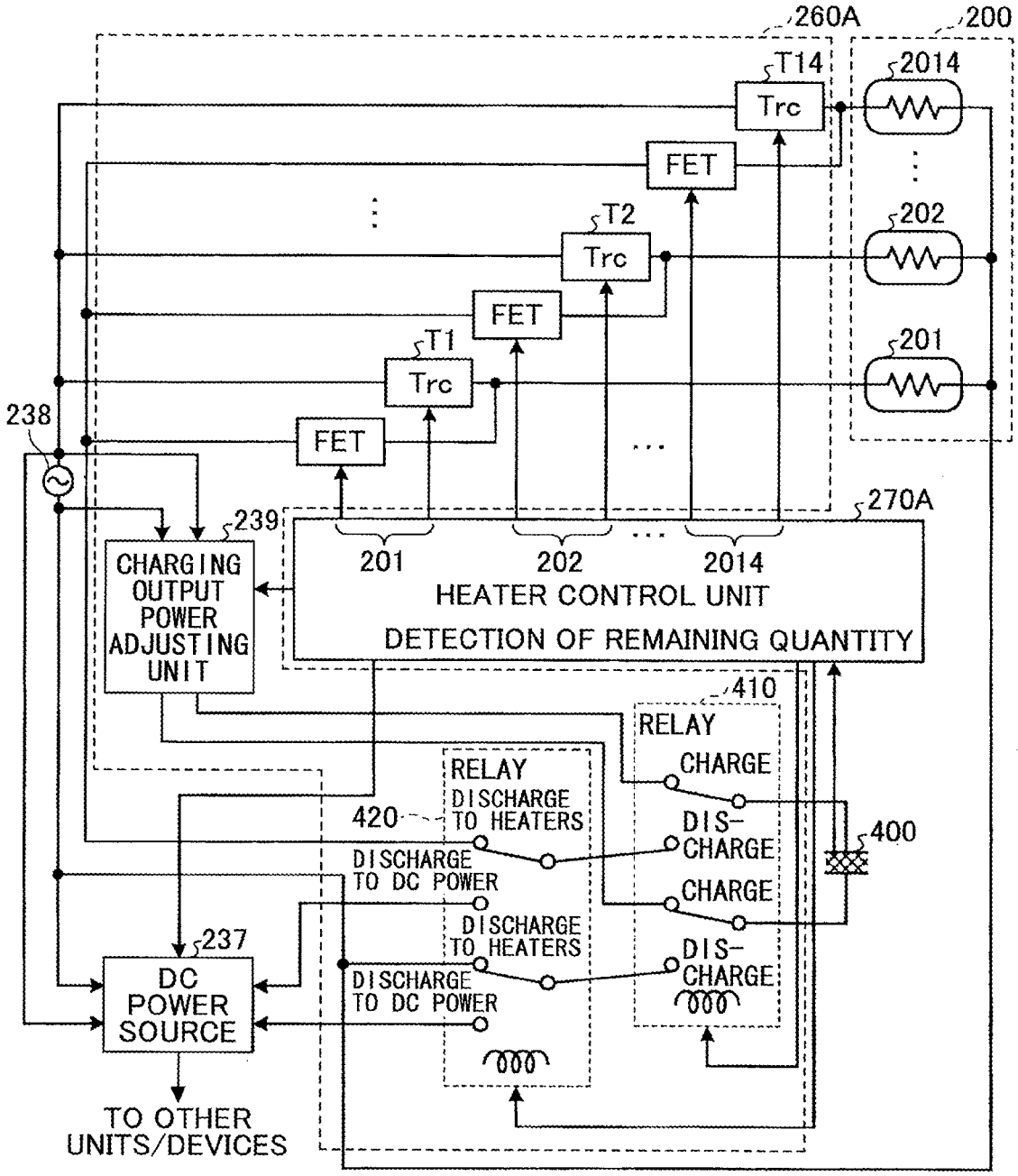
FIG. 31 is a diagram for explaining an example of a heater drive unit according to the fifth embodiment.

FIG. 31 is a diagram for explaining an example of the heater drive unit 260A according to the fifth embodiment. The heater drive unit 260A includes switching elements FETs, switching elements (TRIACs) T1-T14, a charging output power adjusting unit 239, and relay circuits 410 and 420.

In this embodiment, when preheating the heaters 20*n* before and after the image region is present for the purpose of prevention of voltage fluctuation or flicker, the heater drive unit 260A performs an operation in which electricity obtained by the preheating is temporarily stored in the capacitor unit 400. In the following, the electricity or energy obtained when the preheating is performed on the heaters 20*n* before and after the image region is present is called the intermediate energy.

The intermediate energy may be in between a standby energy and a fixing heating energy. The standby energy is electric energy needed to set the temperature of the heaters 20*n* to a temperature in the base temperature range or the sheet temperature range. The fixing heating energy is electric energy needed to set the temperature of the heaters 20*n* to a temperature in the fixing temperature range.

The intermediate energy may be computed by the change amount computation unit 271 in the heater control unit 270A based on the electric power supplied to the heaters 20*n* assigned to the image region. Moreover, in this embodiment, the standby energy and the fixing heating energy are predetermined, and the intermediate energy may be computed based on the standby energy and the fixing heating energy.

Moreover, the intermediate energy may be predetermined as being equal to a specific percent of the fixing heating energy. Further, if the standby energy and the fixing heating energy are obtained, the average of the two energies may be computed as being the intermediate energy. This intermediate energy is generated by the charging output power adjusting unit 239 in response to a request output from the heater control unit 270A.

In this embodiment, when the capacitor unit 400 is connected to the charging output power adjusting unit 239 (charge side) by the relay circuit 410, the capacitor unit 400 stores electric energy. Moreover, when the capacitor unit 400 is connected to the discharge side by the relay circuit 410 and the capacitor unit 400 is connected to the heater 20*n* or the DC power source 237 by the relay circuit 420, the electric energy stored in the capacitor unit 400 is discharged to the heater 20*n* or the DC power source 237.

Thus, in the heater drive unit 260A according to this embodiment, the electric energy consumed to preheat the heaters 20*n* for the non-image region is temporarily stored in the capacitor unit 400 as the intermediate energy and the intermediate energy stored in the capacitor unit 400 may be effectively used to heat the heater 20*n* in the image region.

As shown in FIG. 31, the AC power source 238 is connected to the heaters 201-2014 in the heater portion 200 through the switching elements (Trc) T1-T14. In this embodiment, the heating control of each of the heaters 201-2014 is performed by a control signal output from the heater control unit 270A. In order to control the switching elements T1-T14, it is necessary to form peripheral circuits using photocouplers, transistors, or resistors. In FIG. 31, the illustration of these circuits is omitted for the sake of convenience.

The AC power source 238 is further connected to the charging output power adjusting unit 239. The heater control unit 270A may arbitrarily adjust the output power of the charging output power adjusting unit 239 by outputting a control signal to the charging output power adjusting unit 239. More specifically, the heating organization circuit 270A controls the output of the power supply of the charging output power adjusting unit 239 for each of the time of turning off the power supply to the heaters 20*n* and the time of turning on the power supply to cause the full activation of the heaters 20*n*. When the relay circuit 410 is connected to the charging output power adjusting unit 239 by the heater control unit 270A, the capacitor unit 400 temporarily stores the electric energy output from the charging output power adjusting unit 239.

In this embodiment, when the heater control unit 270A controls the relay circuit 410 to be connected to the discharge side and controls the relay circuit 420 to be connected to the heaters 201-2014, the capacitor unit 400 and the heaters 201-2014 form a discharge circuit through the switching elements FET. Hence, the heater control unit 270A supplies the power output from the capacitor unit 400 to the heaters 201-2014 by outputting the FET control signal to each of the switching elements FET.

The heater control unit 270A is configured to control the switching elements FETs and the switching elements T1-T14 so that, when one of the switching elements FETs is turned ON, the corresponding one of the switching units T1-T14 is turned OFF.

Moreover, in this embodiment, when the heater control unit 270A controls the relay circuits 410 and 420 so that the relay circuit 410 is connected to the discharge side and the relay circuit 420 is connected to the DC power source 237 as the discharge side, the capacitor unit 400 and the DC power source 237 are connected together, and the electric energy stored in the capacitor unit 400 is outputted to the DC power source 237. In this case, the heater control unit 270A outputs a control signal to the DC power source 237 so that the input of the DC power source 237 is switched to the DC input terminal from the capacitor unit 400.

During normal operation, the DC power source 237 operates using AC voltage supplied from the AC power source 238 and outputs the DC voltage. Only when the discharge energy from the capacitor unit 400 is used, the DC power source 237 operates using DC voltage supplied from the capacitor unit 400. The DC voltage output from the DC power source 237 is used as the power supply to units/devices other than the fixing device 128A.

In the heater control unit 270A according to this embodiment, the power supply to the heaters 20*n* is monitored in advance, and when the amount of change of the heating amount is greater than or equal to the threshold, the intermediate energy is temporarily stored in the capacitor unit 400 for the non-image region which is present before and after the image region is present. In other words, in this embodiment, when the amount of change of the heating amount does not exceed the threshold, the heater control unit 270A does not perform the storage of the intermediate energy in the capacitor unit 400 for the non-image region before and after the image region.

In this embodiment, when the amount of change of the heating amount supplied to the heaters 20*n* for the image region and the non-image region is greater than or equal to the threshold, the intermediate energy is stored in the capacitor unit 400 before the power supply to the heaters 20*n* corresponding to the image region is started. When the heaters 20*n* corresponding to the image region are activated, the electric energy stored in the capacitor unit 400 (storage energy) is discharged to the heaters 20*n*. Therefore, in this embodiment, the AC power source 238 may supply to the heaters 20*n* only the amount of the energy equivalent to the result of a subtraction of the intermediate energy from the fixing heating energy of the heaters 20*n*. Consequently, the fluctuation of the power supply from the AC power source 238 to the heaters 20*n* may be reduced and the occurrence of flicker may be prevented.

In this embodiment, when the amount of change of the power supply to the heaters 20*n* is less than the threshold, it is expected that flicker does not occur, and at this time the storage of the intermediate energy in the capacitor unit 400 is not performed. Hence, the power greater than needed is not used and the energy consumption may be reduced.

In the fixing control device according to this embodiment, performance of the operation of storing the intermediate energy in the capacitor unit 400 is determined based on whether the amount of change of the power supply to the heaters 20*n* is greater than (or equal to) the threshold. Hence, when the image portion as indicated by "0" in FIG. 28B is present, the amount of change of the power supply is less than the threshold and the storage of the intermediate energy in the capacitor unit 400 is not performed. Therefore, the energy consumption may be reduced.

The above-described storage energy may be effectively used as a part of the fixing heating energy. Additionally, the above-described storage energy may be effectively used in the following instances (1) and (2).

(1) When a rear end portion of an image is present, the storage energy may be used as a part of the fixing heating energy for an image region in which the amount of change of the power supply is less than the threshold.

In this case, the storage energy is reused as the fixing heating energy for the image portion in which the amount of change is small, and the occurrence of flicker may be prevented and the energy may be used effectively.

(2) The storage energy may be used as electric power of the DC power source other than the fixing heating power.

In this case, the storage energy may be used for operations or processes of the image forming apparatus other than the heating of the heaters 20*n*, so that the energy may be used effectively. If the storage energy is used only for the fixing heating power, the timing of electric discharge may be lost. In this embodiment, prompt electric discharge is possible by discharging the stored energy to the AC and DC power sources which always consume power.

Moreover, when the capacitance of the capacitor unit 400 is small, or in a case of a certain image, the storage energy may not be used for discharging until the timing of the next storage of electricity. In such cases, it is expected that the charging of the capacitor unit 400 cannot be performed. In this embodiment, to prevent occurrence of flicker, the intermediate energy which is to be stored in the capacitor unit 400 may be compulsorily consumed as the fixing heating power for the non-image region.

Furthermore, depending on the state of the image or the remaining quantity of the capacitor unit 400, there is a case in which sufficient electricity cannot be stored even when consumption of the intermediate energy is needed. In order to eliminate the problem, the heater control unit 270A may be arranged to further include a function of detecting the remaining quantity of the capacitor unit 400. When it is detected by this function that sufficient electricity cannot be stored, the heater control unit 270A may supply to the heaters 201-2014 the intermediate energy before and after the image region is present.

Moreover, the heater control unit 270A of this embodiment may be arranged to discharge the stored energy when the remaining quantity of the capacitor unit 400 exceeds a predetermined value.

Moreover, the heater control unit 270A of this embodiment may be arranged to determine whether the stored energy is higher than the electric energy needed to fix the image in one sheet by the heater 20*n*. When the stored energy is determined as being greater than the electric energy needed, the heater control unit 270A may discharge the stored energy to the heater 20*n*.

Thus, according to this embodiment, the electric power may be used effectively by supplying the discharge energy from the capacitor unit 400 storing the intermediate energy to the heaters 201-2014 or the DC power source 237.

In short, according to this embodiment, a change of the power supply to the heater 20*n* is detected for the image region and the non-image region, and when the change is greater than or equal to the threshold, the intermediate energy is generated before and after the image region, the intermediate energy is temporarily stored in the capacitor unit 400, and the stored energy is used effectively later at an appropriate time.

In this embodiment, for the non-image region immediately before and after the image region, the power consumption may be performed using the stored energy, and rapid power change at the transitions from the image region to the non-image region and from the non-image region to the image region may be prevented.

In other words, in this embodiment, the transitions of the electric power consumed for the fixing from the low power for the non-image region to the high power for the image region or from the high power for the image region to the low power for the non-image region are turned into the transitions from the high power for the image region through the intermediate energy of the capacitor unit to the low power for the non-image region or from the low power for the non-image region through the intermediate energy of the capacitor unit to the high power for the image region. Accordingly, the occurrence of flicker may be prevented and rapid power fluctuation may be suppressed.

Moreover, in this embodiment, the stored energy may be effectively used as the power other than the fixing heating power, and it is possible to provide the fixing device with good energy saving performance.

In the above-described embodiments, the present invention is applied to the image forming apparatus having at least two functions among a copier function, a printer function, a scanner function, and a facsimile function. However, the present invention is also applicable to image forming apparatuses such as copiers, printers, scanners, and facsimile machines.

As described in the foregoing, in the fixing control device according to the present invention, good fixing performance may be secured and occurrence of flicker may be prevented.

The fixing control device according to the present invention is not limited to the above-described embodiments, and fluctuations and modifications may be made without departing from the scope of the present invention.

The present application is based upon and claims the benefit of priority of Japanese Patent Application No. 2013-052501, filed on Mar. 14, 2013, Japanese Patent Application No. 2013-053927, filed on Mar. 15, 2013, Japanese Patent Application No. 2013-082748, filed on Apr. 11, 2013, and Japanese Patent Application No. 2014-045488, filed on Mar. 7, 2014, the contents of which are incorporated herein by reference in their entirety.

What is claimed is:

1. A fixing control device which controls a fixing device including a plurality of heaters to fix an image based on image data to a recording material, the fixing control device comprising:

an image detection unit configured to determine presence or absence of the image in each of a plurality of areas obtained by division of an image formation region in which the image is formed;

a heater selection unit configured to select, from the plurality of heaters, heaters at positions corresponding to areas in which the presence of the image is determined;

a heating amount computation unit configured to compute a heating amount of a heating area heated by each of the selected heaters in a fixing region corresponding to the image formation region;

a change amount computation unit configured to compute an amount of change of the heating amount between adjoining ones of the heating areas;

a heating amount correction unit configured to correct one of the heating amounts of the adjoining heating areas so that the amount of change after the correction is less than a set threshold; and a heater drive unit configured to supply a drive signal of a set period to each of the plurality of heaters and turn ON and OFF power supply to each of the plurality of heaters by the drive signal, wherein each of the heating areas in the fixing region is an area heated by a heater when the drive signal of one period is supplied to the heater, and the change amount computation unit computes an amount of change of the heating amounts of the adjoining heating areas in a sub-scanning direction, and wherein the plurality of heaters are arranged in a line in a main scanning direction, the heating amount computation unit computes a sum of the heating amounts of the heating areas heated by the plurality of heaters, and the change amount computation unit computes a difference between a sum of the heating amounts of the heating areas during an N-th period of the drive signal and a sum of the heating amounts of the heating areas during an (N+1)-th period of the drive signal.

2. The fixing control device according to claim 1, wherein the heating amount correction unit is configured to increase one of the heating amounts of the adjoining heating areas in a sub-scanning direction when the amount of change is greater than or equal to the set threshold.

3. The fixing control device according to claim 1, wherein the image detection unit is configured to obtain a sum of respective counted values of pixels in the plurality of areas by counting pixels in each of the plurality of areas, and determine the presence of the image in a corresponding area when the sum is greater than or equal to a set value.

4. The fixing control device according to claim 1, wherein the image formation region in which the image is formed is a writing region scanned by a light beam emitted to form an electrostatic latent image based on the image data, and the image detection unit is configured to obtain a sum of respective counted numbers of times of turning ON lighting of a light emitting device for the plurality of areas based on a light-on control signal to control the light emitting device to emit the light beam.

5. The fixing control device according to claim 1, wherein the image formation region in which the image is formed is a region represented by the image data, and the fixing control device further comprises a pixel counting unit configured to obtain a sum of respective counted values of pixels in each of the plurality of areas when the plurality of areas are obtained by division of the image data.

6. The fixing control device according to claim 3, wherein the sum of the respective counted values is stored in a register corresponding to each area, and the heater selection unit determines a position of the area in the image formation region based on an address of the register and selects a corresponding heater at the position of the area.

7. The fixing control device according to claim 1, further comprising a heater drive unit configured to supply a drive signal of a set period to each of the plurality of heaters and turn ON and OFF power supply to each of the plurality of heaters by the drive signal, wherein the heating amount correction unit is configured to cause the heater drive unit to perform, when the amount of change is greater than or equal to the set threshold, a soft start and a soft stop in turning ON and OFF the power supply to a corresponding one of the plurality of heaters.

8. A fixing control device which controls a fixing device including a plurality of heaters to fix an image based on image data to a recording material, the fixing control device comprising:

an image detection unit configured to determine presence or absence of the image in each of a plurality of areas obtained by division of an image formation region in which the image is formed;

a heater selection unit configured to select, from the plurality of heaters, heaters at positions corresponding to areas in which the presence of the image is determined;

a heating amount computation unit configured to compute a heating amount of a heating area heated by each of the selected heaters in a fixing region corresponding to the image formation region in which the image is formed;

a change amount computation unit configured to compute an amount of change of the heating amount between adjoining ones of the heating areas;

a heater drive unit configured to supply a drive signal of a set period to each of the plurality of heaters and turn ON and OFF power supply to each of the plurality of heaters by the drive signal;

a threshold checking unit configured to determine whether the amount of change of the heating amount between the adjoining heating areas is greater than or equal to a set threshold; and a capacitor unit configured to store electric energy temporarily, wherein, when the amount of change of the heating amount is determined as being greater than or equal to the set threshold and an area in which the absence of the image is determined is detected before and after the areas in which the presence of the image is determined, the heater drive unit causes the capacitor unit to store electric energy whose amount is less than an amount of electric energy supplied to the heaters at the positions corresponding to the areas in which the presence of the image is determined.

9. A fixing control method performed by a fixing control device which controls a fixing device including a plurality of heaters to fix an image based on image data to a recording material, the fixing control method comprising:

determining presence or absence of the image in each of a plurality of areas obtained by division of an image formation region in which the mage is formed;

selecting, from the plurality of heaters, heaters at positions corresponding to the areas in which the presence of the image is determined;

computing a heating amount of a heating area heated by each of the selected heaters in a fixing region corresponding to the image formation region;

computing an amount of change of the heating amount between adjoining ones of the heating areas;

correcting one of the heating amounts of the adjoining heating areas so that the amount of change after the correction is less than a set threshold; and supplying a drive signal of a set period to each of the plurality of heaters and turn ON and OFF power supply to each of the plurality of heaters by the drive signal, wherein each of the heating areas in the fixing region is an area heated by a heater when the drive signal of one period is supplied to the heater, so as to compute an amount of change of the heating amounts of the adjoining heating areas in a sub-scanning direction, and wherein the plurality of heaters are arranged in a line in a main scanning direction, so as to compute a sum of the heating amounts of the heating areas heated by the plurality of heaters, and computes a difference between a sum of the heating amounts of the heating areas during an N-th period of the drive signal and a sum of the heating amounts of the heating areas during an (N+1)-th period of the drive signal.

10. An image forming apparatus comprising:

a fixing device including a plurality of heaters to fix an image based on image data to a recording material; and the fixing control device according to claim 1 which controls the fixing device.

11. A fixing control device which controls a fixing device including a plurality of heaters to fix an image based on image data to a recording material, the fixing control device comprising:

an image detection unit configured to determine presence or absence of the image in each of a plurality of areas obtained by division of an image formation region in which the image is formed;

a heater selection unit configured to select, from the plurality of heaters, heaters at positions corresponding to areas in which the presence of the image is determined;

a heating amount computation unit configured to compute a heating amount of a heating area heated by each of the selected heaters in a fixing region corresponding to the image formation region;

a change amount computation unit configured to compute an amount of change of the heating amount between adjoining ones of the heating areas; and a heating amount correction unit configured to correct one of the heating amounts of the adjoining heating areas so that the amount of change after the correction is less than a set threshold, wherein the image formation region in which the image is formed is a writing region scanned by a light beam emitted to form an electrostatic latent image based on the image data, and the image detection unit is configured to obtain a sum of respective counted numbers of times of turning ON lighting of a light emitting device for the plurality of areas based on a light-on control signal to control the light emitting device to emit the light beam.

* * * * *